US009399986B2

(12) United States Patent
Nelson et al.

(10) Patent No.: US 9,399,986 B2
(45) **Date of Patent: *Jul. 26, 2016**

(54) DEVICES AND SYSTEMS FOR ISOLATING BIOMOLECULES AND ASSOCIATED METHODS THEREOF

(75) Inventors: John Richard Nelson, Clifton Park, NY (US); Li Zhu, Clifton Park, NY (US); Xiaohui Chen, Niskayuna, NY (US); Christopher Michael Puleo, Niskayuna, NY (US); Patrick McCoy Spooner, Slingerlands, NY (US)

(73) Assignee: General Electric Company, Niskayuna, NY (US)

( * ) Notice: Subject to any disclaimer, the term of this patent is extended or adjusted under 35 U.S.C. 154(b) by 308 days.

This patent is subject to a terminal disclaimer.

(21) Appl. No.: 13/599,131

(22) Filed: Aug. 30, 2012

(65) Prior Publication Data

US 2014/0039172 A1 Feb. 6, 2014

Related U.S. Application Data

(63) Continuation-in-part of application No. 13/562,947, filed on Jul. 31, 2012.

(51) Int. Cl.
*C07H 21/00* (2006.01)
*C07H 21/02* (2006.01)
(Continued)

(52) U.S. Cl.
CPC ..... *F04B 19/006* (2013.01); *F04B 19/04* (2013.01); *F04B 19/20* (2013.01)

(58) Field of Classification Search
CPC ..... B01J 2219/00659; B01J 2219/00722; B01L 7/52; B01L 2300/0636; B01D 35/26; B01D 29/05; B01D 35/02; B01D 65/08; C40B 40/06; C02F 9/00; C02F 2209/005; C02F 2209/008; C02F 1/283; C02F 1/32
USPC ..... 435/287.3; 536/23.1, 25.24; 210/416.1, 210/143
See application file for complete search history.

(56) References Cited

U.S. PATENT DOCUMENTS 3,923,426 A * 12/1975 Theeuwes ..... 204/630
4,693,834 A 9/1987 Hossom
(Continued)

FOREIGN PATENT DOCUMENTS

EP 1043588 A1 10/2000
JP 2006063031 A 3/2006
(Continued)

OTHER PUBLICATIONS

International Search Report and Written Opinion issued in connection with corresponding PCT Application No. PCT/EP2013/063541 dated Oct. 24, 2013.
(Continued)

*Primary Examiner* — William H Beisner
*Assistant Examiner* — Danielle Henkel
(74) *Attorney, Agent, or Firm* — Eileen B. Gallagher

(57) ABSTRACT

A device, a system, and a method for isolating biomolecules from biological materials are provided. The device comprises a quartz-based solid phase extraction matrix comprising one or more reagents impregnated therein; and an electroosmotic pump (EOP) operationally coupled to the quartz-based solid phase extraction matrix to elute the nucleic acids, wherein the EOP comprises a plurality of electroosmotic membranes comprising one or more positive electroosmotic membranes and one or more negative electroosmotic membranes disposed alternatively and a plurality of electrodes comprising one or more cathodes and one or more anodes, wherein at least one cathode is disposed on one side of one of the membranes and at least one anode is disposed on another side of that membrane and at least one cathode or anode is disposed between a positive electroosmotic membrane and a negative electroosmotic membrane.

13 Claims, 9 Drawing Sheets

(51) Int. Cl.

| | |
|---|---|
| ***C07H 21/04*** | (2006.01) |
| ***B01D 11/02*** | (2006.01) |
| ***F04B 19/00*** | (2006.01) |
| ***F04B 19/04*** | (2006.01) |
| ***F04B 19/20*** | (2006.01) |

(56) References Cited

U.S. PATENT DOCUMENTS

| | | | | |
|---|---|---|---|---|
| 5,346,999 | A | 9/1994 | Cathcart et al. | |
| 5,352,777 | A | 10/1994 | Jhingan | |
| 5,496,562 | A | 3/1996 | Burgoyne | |
| 6,503,762 | B1 | 1/2003 | Yamauchi et al. | |
| 6,534,262 | B1 | 3/2003 | Mckernan et al. | |
| 6,555,945 | B1 | 4/2003 | Baughman et al. | |
| 6,627,226 | B2 | 9/2003 | Burgoyne et al. | |
| 6,787,307 | B1 | 9/2004 | Bitner et al. | |
| 6,803,200 | B2 | 10/2004 | Xia et al. | |
| 6,881,541 | B2 | 4/2005 | Petersen et al. | |
| 7,498,133 | B2 | 3/2009 | Fomovskaia et al. | |
| 7,534,623 | B2 | 5/2009 | Landers et al. | |
| 7,722,817 | B2 | 5/2010 | Lauks et al. | |
| 7,759,112 | B2 | 7/2010 | Belgrader | |
| 7,824,855 | B2 | 11/2010 | Inomata et al. | |
| 7,914,994 | B2 | 3/2011 | Petersen et al. | |
| 7,931,920 | B2 | 4/2011 | Hildebrand | |
| 7,939,249 | B2 | 5/2011 | Parthasarathy et al. | |
| 7,964,380 | B2 | 6/2011 | Utermohlen et al. | |
| 8,124,026 | B2 | 2/2012 | Lauks et al. | |
| 8,603,834 | B2 * | 12/2013 | Puleo | B01L 3/50273 251/12 |
| 9,103,331 | B2 * | 8/2015 | Puleo | F04B 19/006 |
| 2002/0036170 | A1 | 3/2002 | Harvey et al. | |
| 2003/0152974 | A1 | 8/2003 | Gauch et al. | |
| 2003/0199078 | A1 | 10/2003 | Kleiber et al. | |
| 2004/0035775 | A1 | 2/2004 | Bonner et al. | |
| 2005/0026177 | A1 | 2/2005 | Urthaler et al. | |
| 2005/0042716 | A1 | 2/2005 | Nakajima et al. | |
| 2005/0266462 | A1 | 12/2005 | Weindel et al. | |
| 2006/0108286 | A1 | 5/2006 | Hambitzer et al. | |
| 2006/0115857 | A1 | 6/2006 | Keen | |
| 2006/0169588 | A1 | 8/2006 | Jacobson et al. | |
| 2008/0023395 | A1 | 1/2008 | Chen et al. | |
| 2008/0132694 | A1 | 6/2008 | Himmelreich et al. | |
| 2008/0227185 | A1 * | 9/2008 | Schonfeld et al. | 435/287.2 |
| 2009/0104076 | A1 | 4/2009 | Staab | |
| 2009/0314639 | A1 | 12/2009 | Faupel et al. | |
| 2010/0003666 | A1 | 1/2010 | Lee et al. | |
| 2010/0112576 | A1 | 5/2010 | Patil | |
| 2010/0285578 | A1 | 11/2010 | Selden et al. | |
| 2010/0297754 | A1 * | 11/2010 | Solli et al. | 435/325 |
| 2011/0052431 | A1 * | 3/2011 | Heldal et al. | 417/410.1 |
| 2011/0097215 | A1 | 4/2011 | O'Shaughnessy et al. | |
| 2011/0124098 | A1 | 5/2011 | Rose et al. | |
| 2011/0195495 | A1 | 8/2011 | Selden et al. | |
| 2013/0153425 | A1 | 6/2013 | Puleo et al. | |
| 2013/0156615 | A1 * | 6/2013 | Puleo | A61K 9/0004 417/410.1 |
| 2014/0190831 | A1 * | 7/2014 | Puleo | B01L 3/50273 204/600 |

FOREIGN PATENT DOCUMENTS

| | | | |
|---|---|---|---|
| WO | 9922868 | A1 | 5/1999 |
| WO | 2006132666 | A1 | 12/2006 |
| WO | 2007011919 | A2 | 1/2007 |
| WO | 2012082849 | A1 | 6/2012 |

OTHER PUBLICATIONS

International Search Report and Written opinion issued in connection with related PCT Application No. PCT/US2013/052825 dated Dec. 24, 2013.

International Search Report and Written opinion issued in connection with related PCT Application No. PCT/048853 dated Feb. 21, 2014.

Hunkapiller et al.,"Large-Scale and Automated DNA Sequence Determination", Science, vol. 254, Issue 5028, Oct. 4, 1991; Abstract—1 Page.

Mollova et al., "An Automated Sample Preparation System with Mini-Reactor to Isolate and Process Submegabase Fragments of Bacterial DNA", Analytical Biochemistry, vol. 391, Issue 2, pp. 135-143, Aug. 15, 2009.

* cited by examiner

DEVICES AND SYSTEMS FOR ISOLATING BIOMOLECULES AND ASSOCIATED METHODS THEREOF

CROSS REFERENCE TO RELATED APPLICATIONS

This application is a continuation-in-part of U.S. patent application Ser. No. 13/562,947 entitled "Devices and Systems for Isolating Biomolecules and Associated Methods Thereof", filed Jul. 31, 2012; which is herein incorporated by reference.

STATEMENT REGARDING FEDERALLY SPONSORED RESEARCH & DEVELOPMENT

This invention was made with Government support under contract number HDTRA1-10-C-0033 awarded by the Defense Threat Reduction Agency. The Government has certain rights in the invention.

SEQUENCE LISTING

The instant application contains a Sequence Listing which has been submitted in ASCII format via EFS-Web and is hereby incorporated by reference in its entirety. Said ASCII copy, created on Sep. 5, 2012, is named 254155-1.txt and is 1,235 bytes in size.

FIELD

The invention relates to a device and a system for isolating biomolecules from a biological sample, comprising multiple matrices for biomolecule extraction, and elution.

BACKGROUND

Preparation and manipulation of high quality nucleic acid is a significant step in molecular biology. The purified nucleic acids isolated from various sources are required for subsequent molecular or forensic analysis. Various methods can be used to extract, isolate and purify nucleic acids for a variety of applications, such as analyte detection, sensing, forensic and diagnostic applications, genome sequencing, and the like. The conventional methods for nucleic acid sample preparation generally include isolation of the sample, extraction of the intracellular components, purification of the nucleic acids, and post-processing treatment for stabilizing the end product. However, the conventional method is a time consuming, labor intensive process with a risk of contamination and nucleic acid degradation.

A number of methods and reagents for nucleic acid isolation and purification have been developed to allow the direct coupling of nucleic acids onto solid supports followed by extraction, such as solid phase extraction technology. Solid-phase extraction (SPE) technology has been leveraged to reduce the extraction times of high purity nucleic acids for sequencing and other applications. SPE techniques are typically performed using a siliceous or ion exchange material as the solid phase. Porous filter membrane materials, such as cellulose, can also be used for non-covalent or physical entrapment of nucleic acid. However, the porous filter membrane materials are traditionally relegated to nucleic acid storage applications due to low extraction efficiencies of nucleic acid from the matrix and laborious purification from the embedded lytic and stabilization chemicals.

For applications requiring high throughput, robotic solutions allow the sample or reagent handling in SPE processes to be automated. However, the robots are expensive, space consuming, and difficult to move from one place to another, and therefore, are not suitable for use in the field, and incompatible with other analytical devices for further downstream applications. By translating and miniaturizing the bench-top processes, a microfluidic device can eliminate the need for manual intervention between different steps, minimize the size, weight or reagent and power consumption of the device compared to the current robotic platforms. Although microfluidic technology enables a high-speed, high-throughput nucleic acid sample preparation, isolation of nucleic acids in a microfluidic environment typically requires a myriad of external control equipment, including compressed air sources or high pressure syringe pumps.

A significant degradation of the nucleic acids occurs using the conventional elution methods, such as heating or mechanical stress. For example, heating of a matrix to facilitate elution of bound nucleic acids results in a high number of single strand-breaks or a spontaneous depurination followed by cleavage of phosphodiester linkages in the eluted nucleic acids. In some other examples, mechanical stress is induced to facilitate nucleic acid elution from a matrix, which includes agitation by vortexing the matrix bound nucleic acids, repeated pipetting of the nucleic acids, or crushing of the matrix. An extra precaution is desirable for eluting high molecular weight nucleic acids, for example, nucleic acids having a length of above 10,000 to 20,000 nucleotides, and especially above 100,000 nucleotides, as high molecular weight nucleic acids are prone to degradation by mechanical stress, harsh treatment or manual handling. In other methods, nucleic acids containing abasic sites are sensitive to pH above 7, and are degraded on even short exposure to high pH. Therefore, elution method that minimizes number of steps and manual handling is desirable to maintain integrity of the nucleic acid.

Hand-held devices or cards with embedded fluidics to process biological sample are well known in the art and used for various applications, such as in-house pregnancy tests, however, these devices are limited to processing only small volumes of biological samples. Lab-scale pumps are necessary for standard biological sample preparation using ultrafiltration, microfiltration, chromatography or solid phase extraction; however these technologies have generally operated in high pressure, bench-top systems. Therefore, there is a substantial need for smaller, simpler, self-contained automated fluidic devices that can process large biological sample volumes for cell lysis, nucleic acid extraction, and purification processes with minimal human intervention.

BRIEF DESCRIPTION

One embodiment of a device for isolating nucleic acids, comprises a quartz-based solid phase extraction matrix; and an electroosmotic pump (EOP) operationally coupled to the quartz-based solid phase extraction matrix to elute the nucleic acids, wherein the EOP comprises a plurality of electroosmotic membranes comprising one or more positive electroosmotic membranes and one or more negative electroosmotic membranes disposed alternatively and a plurality of electrodes comprising one or more cathodes and one or more anodes, wherein at least one cathode is disposed on one side of one of the membranes and at least one anode is disposed on another side of that membrane and at least one cathode or anode is disposed between a positive electroosmotic membrane and a negative electroosmotic membrane.

In one embodiment, a system comprises a device for isolating nucleic acids, one or more reservoirs comprising a buffer, a solvent, a reagent or combinations thereof, a fluidic circuit for flowing liquid through the device, and a controller. The device comprises a quartz based extraction matrix; and an electroosmotic pump (EOP) operationally coupled to the quartz based extraction matrix, wherein the EOP comprises a plurality of electroosmotic membranes comprising one or more positive electroosmotic membranes and one or more negative electroosmotic membranes disposed alternatively and a plurality of electrodes comprising one or more cathodes and one or more anodes, wherein at least one cathode is disposed on one side of one of the membranes and at least one anode is disposed on another side of that membrane and at least one cathode or anode is disposed between a positive electroosmotic membrane and a negative electroosmotic membrane.

One example of a method of isolating nucleic acids from a biological material, comprises applying the biological material on a quartz-based solid phase extraction matrix comprising one or more cell lysis reagents impregnated therein; applying a fluid to the biological material applied on the quartz-based solid phase extraction matrix; extracting the nucleic acids from the biological material applied on the solid phase extraction matrix; and collecting the extracted nucleic acids in a substantially intact form, without any human intervention, wherein applying the fluid to extract and collect the nucleic acids by electroosmotic pump (EOP).

One example of a method of isolating nucleic acids from a biological material, comprises applying a biological material to a quartz-based soild phase extraction matrix comprising one or more cell lysis reagents impregnated therein to extract nucleic acids; washing the matrix comprising the nucleic acids; and eluting the nucleic acids in a substantially intact form without any human intervention, wherein washing and eluting of the biological material occur under a flow rate of less than or equal to 0.1 ml/volt/cm$^2$/minute.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
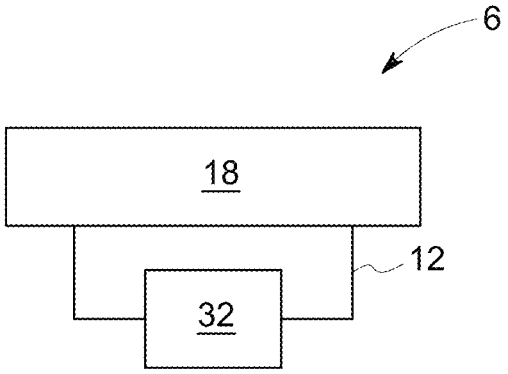
FIG. 1 is a schematic drawing of an embodiment of a device of the invention.

Isolation and purification of nucleic acids, from a wide variety of samples including bacteria, plants, blood, or buccal swabs, are simplified to a greater extent using various embodiments of the device of the invention. Embodiments of the device comprise a solid phase extraction matrix, an active fluid pump, and related electrochemical control elements with the various membrane components. In addition to enabling nucleic acid purification using disposable cartridges, the various embodiments of the device allow multiple applications for elution of nucleic acids from the matrix and subsequent storage as per a given application's requirements.

To more clearly and concisely describe the subject matter of the claimed invention, the following definitions are provided for specific terms, which are used in the following description and the appended claims. Throughout the specification, exemplification of specific terms should be considered as non-limiting examples.

The singular forms "a", "an" and "the" include plural referents unless the context clearly dictates otherwise. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Where necessary, ranges have been supplied, and those ranges are inclusive of all sub-ranges there between.

As used herein, the term "porous material" refers to a material with a plurality of pores, wherein the material is macroporous, microporous, or nanoporous. The porous material may form "porous membranes" and "porous electrodes". The pores can be macropores, micropores or nanopores. In the case of micropores, the average pore size may be, for example, less than about 10 microns, or less than about 5 microns, or less than about one micron. In the case of nanopores, the average pore size may be, for example, about 200 nm to about 10 microns, or about 200 nm to about 5 microns, or about 200 nm to about 3 microns. The porous membranes may be made of inorganic materials such as, silicon, alumina, silicon nitride, or silicon dioxide. The porous electrodes may be made of metals such as, platinum (Pt) or gold (Au), or redox materials, such as metal salts or conductive polymers.

As used herein, the term "operatively coupled" or "operationally coupled" refers to a functional interaction between one or more components. For example, various components are operatively coupled to each other in the device, wherein the components are connected by a fluidic flow while the device is in operation.

As used herein, the terms "multifunctional matrix or membrane" or "MFM" refer to an assembly of multiple matrices, wherein each of the matrices may have different functions than another one. For example, one embodiment of the MFM device is structured with three different types of matrices; one is for nucleic acid extraction, wherein the matrix has a capacity of binding nucleic acids as well as lysing cells using reagents embedded therein. The second matrix is configured to hold two or more buffer reagents, such as wash and elution buffer reagents embedded therein. The second matrix may be a buffer reconstitution substrate. The third type of matrix or matrix-based component may be an internal pressure source, such as an electroosmotic pump (EOP). In some embodiments, the third matrix-based component is an EOP. In some embodiments, one matrix has multiple functions, such as that matrix has the ability to bind nucleic acid and also perform cell lysis using matrix-embedded reagents.

As used herein, the term "substantially intact" refers to a form of nucleic acids that maintains an overall structural integrity, for example, about 70-80%. For example, a nucleic acid that retains its structural integrity of about 70-80% after elution from a matrix, may be referred to as being in a substantially intact form. The device enables purifying substantially intact nucleic acids unlike some of the elution methods from a binding matrix using heat treatment or mechanical stress, as described in background section. The "substantially intact form" means nucleic acids with reduced physical or chemical changes, such as minimal degradation, strand breakage, or chemical-modification of the structural units. The nucleic acids in a substantially intact form are useful for various downstream applications, such as whole genome sequencing, disease detection, identification of mutants, and amplification of nucleic acids. For example, purified human DNA having a length of greater than 20,000 nucleotides is very useful for genome sequencing or disease detection. The purification of a substantially intact form of the nucleic acids is also shown in FIG. 14 when compared to the degraded nucleic acids shown in FIG. 13. FIG. 14 illustrates purification of a substantially intact form of the nucleic acids having a molecular weight of 20 kbp (human genomic DNA) using a quartz-based FTA® matrix.

As used herein, the term "reduced-degradation condition", refers to a process of reducing degradation of the nucleic acids while isolating from a matrix without using any harsh conditions or treatments on the nucleic acids. The harsh treatments may lead to degradation or fragmentation of the nucleic acids. The harsh conditions or treatments may include, but are not limited to, boiling of the nucleic acids, heating of the nucleic acids at a higher temperature, and treating the nucleic acids with a strong detergent or chaotrope or the like. In one embodiment, the elution process uses an electroosmotic pump or EOP, which exerts fluidic pressure on the nucleic acids attached to the matrix. Use of the EOP is an example of a reduced degradation condition.

One or more embodiments of a device for isolating nucleic acids, comprise a quartz-based solid phase extraction matrix comprising one or more reagents impregnated therein, and an EOP operationally coupled to the quartz-based solid phase extraction matrix to elute the nucleic acids, wherein the EOP comprises a plurality of electroosmotic membranes comprising one or more positive electroosmotic membranes and one or more negative electroosmotic membranes disposed alternatively and a plurality of electrodes comprising one or more cathodes and one or more anodes, wherein at least one cathode is disposed on one side of one of the membranes and at least one anode is disposed on another side of that membrane and at least one cathode or anode is disposed between a positive electroosmotic membrane and a negative electroosmotic membrane.

In one or more embodiments, a device for isolating biomolecules from biological materials comprises a substrate, a reagent storage location, and an EOP, wherein the substrate, the reagent storage location and the EOP are operationally coupled to each other, as shown in FIGS. 1, 2, 3 and 4. In some embodiments, the device further comprises a fluidic circuit which connects the substrate, the reagent storage location and the EOP during the isolation process.

One or more embodiments of the device for isolating biomolecules may comprise a quartz-based solid phase extraction matrix or a filtration matrix. The reagent storage location comprises dried buffer reagents or reagents for extraction of nucleic acids, such as cell-lysis reagents or biomolecule stabilizing reagents. In some embodiments of the device, the reagent storage location may also function as a buffer-reconstitution substrate, wherein the dried buffer reagent may be reconstituted in wash or elution buffers using liquids present in the EOP or the liquid may be supplied from outside of the device. The liquid may be stored in an EOP and may be utilized to reconstitute buffer solution. The storage-location may comprise the wash buffer and elution buffer reagents, which may be separated by a partition to form a wash buffer reservoir and an elution buffer reservoir, that contain wash buffer or elution buffer after reconstitution.

Figure 2:
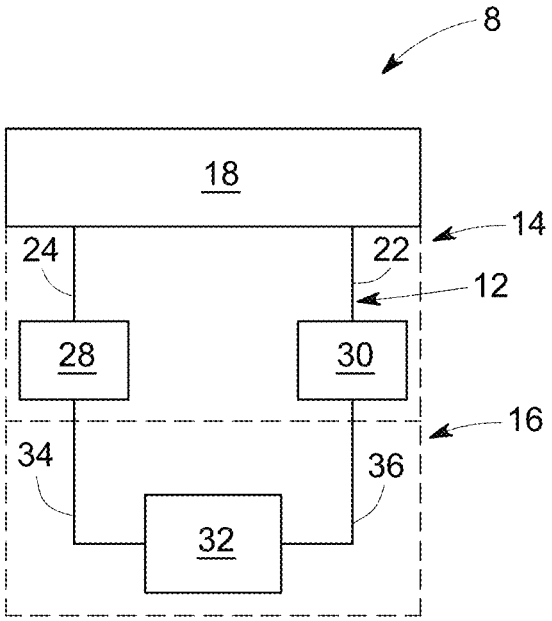
FIG. 2 is a schematic drawing of another embodiment of a device of the invention.

In one or more embodiments, the device is structured in an arrangement of multiple layers. In some embodiments, the device comprises a first layer comprising a solid phase extraction matrix; and at least one EOP, wherein the EOP is operationally coupled to the solid phase extraction matrix, as shown in FIG. 1. In some other embodiments, the device further comprises an intervening layer comprising a buffer reconstitution substrate comprising at least one wash buffer reservoir and one elution buffer reservoir comprising a wash buffer reagent and elution buffer reagent embedded therein respectively, wherein the EOP is operationally coupled to the wash buffer reservoir and the elution buffer reservoir, as shown in FIG. 2. The intervening layer comprising a buffer reconstitution substrate is considered herein as a second layer and the EOP as third layer of the device. In some embodiments, the first, second and third layers are operationally coupled to each other, as shown in FIG. 2. This example is an MFM device.

FIG. 1 illustrates one embodiment of the device 6, wherein the device comprises a quartz-based solid phase extraction matrix 18 and a pressure source 32, wherein the pressure source is an EOP. The device further comprises a fluid circuit 12. The fluid circuit 12 is operationally coupled to the extraction matrix and the pressure source EOP.

FIG. 2 illustrates another embodiment of the device 8, wherein the device comprises a quartz-based solid phase extraction matrix 18 and a third layer 16 comprises a pressure source 32 and a fluid circuit 12, wherein the pressure source is an EOP. The device further comprises a reagent storage location 14 comprises wash buffer reagents 28 or elution buffer reagents 30. The fluid circuit 12 is operationally coupled to the extraction matrix, reagent storage location and the pressure source EOP. The fluidic circuit comprises the conduits 22, 24, 34 and 36. In some exemplary embodiments, the wash buffer reagent and the elution buffer reagent storages are separated by a partition forming a wash buffer reservoir 28 and an elution buffer reservoir 30 respectively and are coupled to the extraction matrix 18. The extraction matrix is coupled to the wash buffer reservoir 28 by a conduit 24 and to the elution buffer reservoir 30 by a conduit 22. The device comprises at least one pressure source, an EOP 32. The EOP is operationally coupled to the wash buffer reservoir 28 by a connection 34 and to the elution buffer reservoir 30 by a connection 36.

Figure 3:
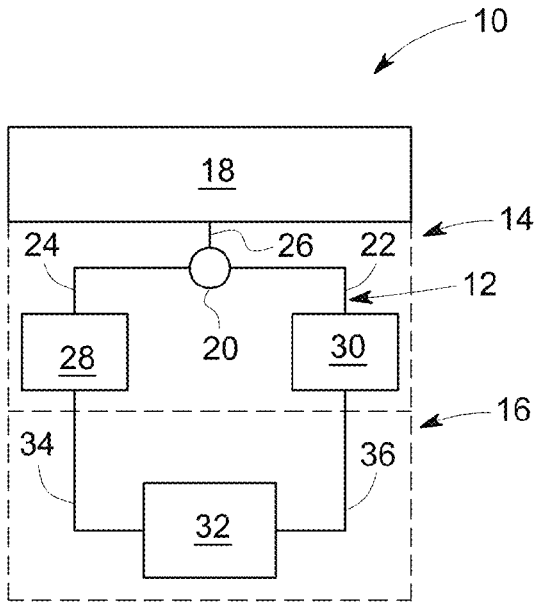
FIG. 3 is a schematic drawing of another embodiment of a device of the invention.

FIG. 3 illustrates a schematic presentation of another embodiment of the device 10, wherein the device comprises a extraction matrix 18, a reagent storage location 14 comprising wash buffer reagents 28 or elution buffer reagents 30, and a third layer 16 comprising a pressure source 32 and a fluid circuit 12. The fluid circuit 12 is operationally coupled to the extraction matrix, reagent storage location and the pressure source (EOP). The fluidic circuit comprises the conduits 22, 24, 26, 34 and 36. In some exemplary embodiments, the wash buffer reagent and elution buffer reagents are stored in a wash buffer reservoir 28 and an elution buffer reservoir 30 respectively and are coupled to the extraction matrix 18. The device may be represented as a three-layered structure, wherein the extraction matrix is referred to herein as a first layer 18, the reagent storage location is referred to herein as a second layer 14 and the third layer 16 comprising EOP, and the layers are operationally coupled to each other. A valve 20 is disposed between the first layer 18 and the second layer 14, wherein the valve is coupled to the wash buffer reservoir 28 by a conduit 24 and to the elution buffer reservoir 30 by a conduit 22. The valve 20 is further coupled to the first layer 18 by a conduit 26. The third layer 16 comprises at least one pressure source, such as an EOP, 32. The EOP is operationally coupled to the wash buffer reservoir 28 by a connection 34 and to the elution buffer reservoir 30 by a connection 36.

Figure 4:
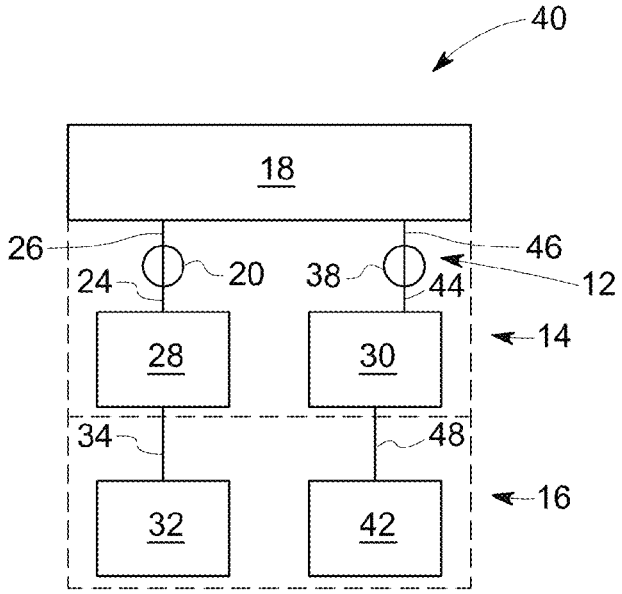
FIG. 4 is a schematic drawing of an embodiment of a device of the invention.

In one embodiment, the device comprises two valves and two pressure sources, such as EOPs, as shown in FIG. 4. FIG. 4 illustrates an embodiment of the device 40, wherein the first layer 18, second layer 14 and third layer 16 are operationally coupled to each other. In some embodiments, the first layer 18 comprises a substrate, and the terms "first layer" and "substrate" are interchangeably used hereinafter, and referred as 18. In some embodiments, the second layer 14 is a reagent storage location and the terms "second layer" and "reagent storage location" are interchangeably used hereinafter, and referred to herein as 14. The reagent storage location comprises a wash buffer reservoir 28 and an elution buffer reservoir 30. Two valves 20 and 38 are disposed between the first layer 18 and the second layer 14, wherein the valve 20 is coupled to the wash buffer reservoir 28 by a conduit 24 and to the first layer by a conduit 26. The valve 38 is coupled to the elution buffer reservoir 30 by a conduit 44 and to the first layer by a conduit 46. The third layer 16 comprises two pressure sources, 32 and 42 respectively. In some embodiments, the third layer 16 comprises one or more EOPs. One of the EOPs 32 is operationally coupled to the wash buffer reservoir 28 by a connection 34 and the other EOP 42 is operationally coupled to the elution buffer reservoir 30 by a connection 48. The fluid circuit 12 encompasses the connectors 26 and 46, and the conduits 24, 44, 34 and 48.

In some embodiments, the substrate is a quartz-based solid phase extraction matrix. The term "substrate" is interchangeably used herein as "matrix" or "extraction matrix". As noted, in one embodiment, the device comprises a solid phase extraction matrix. A substrate, wherein the solid phase extraction method can be performed, is referred to herein as a solid phase extraction matrix. The solid phase extraction is an extraction method that uses a solid phase and a liquid phase to isolate one or more molecules of the same type, or different types, from a material. The solid phase extraction matrix is usually used to purify a sample, in some examples, before using the sample in a chromatographic or other analytical method. The general procedure is to load a material onto the solid phase extraction matrix, wash away undesired components, and then elute the desired molecules with a solvent.

Figure 9:
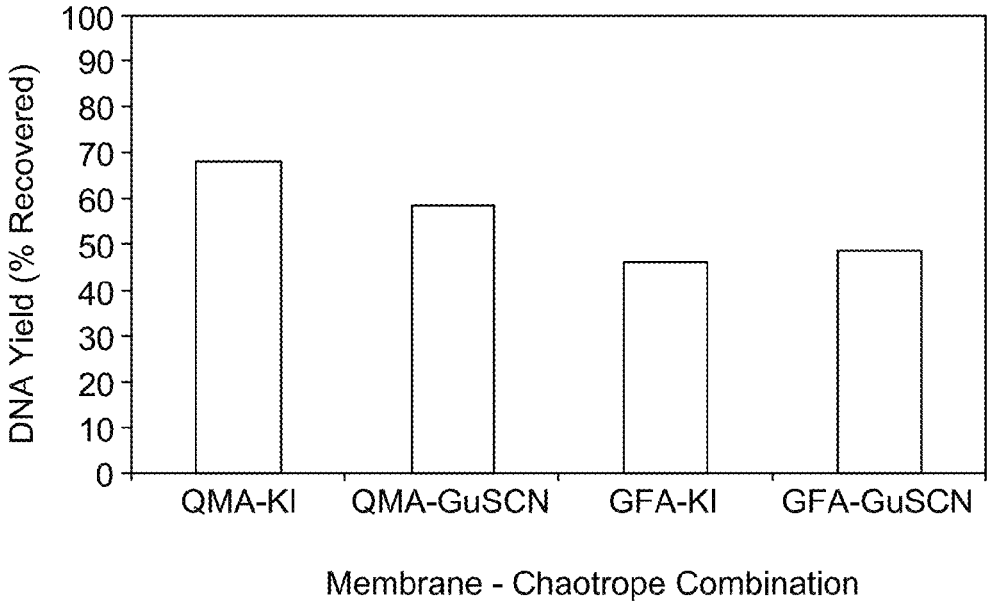
FIG. 9 is a graph showing recovery of DNA using different extraction matrices and chaotrope combinations used in an embodiment of the device of the invention.

In some embodiments, the substrate may comprise quartz. In some embodiments, the quartz based extraction matrix is used for nucleic acid extraction, wherein a sample comprising lysed cells is disposed on the substrate. In these embodiments, the cells are lysed before adding to the substrate, and therefore the substrate may or may not comprise cell-lysis reagents impregnated therein. In one embodiment, the quartz-based solid phase extraction matrix comprises reagents impregnated therein. The density of silanol groups on quartz matrix, when compared to a standard silica matrix, may facilitate a faster and easier extraction of the nucleic acids from the biological materials. When compared with a glass-based matrix using multiple chaotrope and/or detergent combinations, a quartz-based matrix ensures a higher yield of nucleic acids extracted therefrom, under the same conditions. For example, a quartz solid phase extraction matrix, when using a potassium iodide (KI) chaotrope yields about 70% nucleic acids when compared to the yield of about 50%, when using a glass fiber in an Illustra® column, as shown in FIG. 9.

In some embodiments, the extraction matrix comprises one or more cell lysis reagents impregnated therein. In one embodiment, the solid phase extraction matrix is impregnated with one or more reagents for stabilizing biomolecules. The impregnated reagents may comprise a lytic reagent, nucleic acid stabilizing reagent, nucleic acid storage chemical and combinations thereof. In some embodiments, the lysis reagents are embedded in the quartz matrix for cell lysis followed by extraction of the nucleic acids.

The reagents may be impregnated in the solid phase extraction matrix in a dried, semi-dried or wet form. The dried reagents may then be hydrated with a buffer or sample for cell lysis. For example, the quartz-based-FTA substrate comprises lysis reagents in the dried form, and is hydrated by the sample or buffer to reconstitute. In one embodiment, the quartz-based matrix is impregnated with stabilizing reagents, wherein the lysis reagent is added separately to the quartz matrix. The reagent may be added to the matrix along with the sample before, or after, adding the sample. In some embodiments, when the extraction matrix comprises only stabilizing reagents, the lysed cells may be added to the matrix for extraction of nucleic acids.

The lysis reagents may comprise a detergent or a chaotropic agent, weak base, anionic surfactant, chelating agent or uric acid. The detergent is a useful agent for isolating nucleic acids because the detergent has the capacity of disrupting cell membranes and denaturing proteins by breaking protein: protein interactions. The detergent may be categorized as an ionic detergent, a non-ionic detergent, or a zwitterionic detergent. The ionic detergent may comprise cationic detergent such as, sodium dodecylsulphate (SDS) or anionic detergent, such as ethyl trimethyl ammonium bromide. Non-limiting examples of non-ionic detergent for cell lysis includes TritonX-100, NP-40, Brij 35, Tween 20, Octyl glucoside, Octyl thioglucoside or digitonin. Some of the zwitterionic detergents may comprise 3-[(3-Cholamidopropyl)dimethylammonio]-1-propanesulfonate (CHAPS) and 3-[(3-Cholamidopropyl)dimethylammonio]-2-hydroxy-1-propanesulfonate (CHAPSO). Some of the detergents are denaturing or non-denaturing in nature. Non-denaturing non-ionic detergents may include Triton X-100, bile salts, such as cholate and zwitterionic detergents, and may include CHAPS.

The solid phase extraction matrix may comprise a chaotrope for lysing cells. Generally, chaotropes break inter and intra molecular non-covalent interactions. Examples of chaotropes include, but are not limited to, potassium iodide (KI), guanidium hydrochloride, guanidium thiocyanate, or urea. The chaotropes may be categorized as weaker chaotropes and stronger chaotropes depending on their strength of denaturation. The weaker chaotropes may be used for lysing cells, without affecting the nucleic acids. The weaker binding chaotropes or their surface chemistry may be beneficial in the electroosmotic flow-based device.

In one or more embodiments, the lysis reagents used herein is FTA®-lysis reagent, interchangeably used herein as FTA® reagents. The FTA reagents may comprise Tris, EDTA and SDS. In a typical procedure, the cells are spotted onto the matrix, the impregnated SDS lyses the cells, and the EDTA inhibits nuclease to stabilize the nucleic acids. The wash with Tris-EDTA (TE) buffer solution removes most of the SDS, and phenol and/or isopropanol washes removes impurities before elution of the nucleic acids. Such FTA® reagents comprising 50 ul of 2% SDS, 10 mM EDTA, 60 mM Tris solution, as used for cell lysis and nucleic acid purification, are described in U.S. Pat. No. 5,496,562 entitled "Solid Medium and Method for DNA Storage".

In one or more embodiments, the first layer of the device comprises a solid phase extraction matrix impregnated with the lytic reagents and storage chemicals typically associated with FTA® products. In some embodiments, the quartz-based "FTA" uses the FTA® reagents from GE with a combination of quartz matrix (QMA). The glass or quartz-based FTA lyses and deactivates a wide variety of the bacteria and viruses. The glass or quartz-based FTA version provides a simple user interface associated with the additional benefit of having a surface capable of chaotrope-driven solid phase extraction. Unlike the cellulose-based FTA® product that requires over two hours drying time for bacterial inactivation, the glass, quartz or silica-based membrane have shown *E. coli* inactivation within 10 minutes. In some other embodiments, the FTA® reagents impregnated in the quartz matrix are useful for a field-able device, wherein the device is ready to use in a field. The quartz-FTA matrix is also more efficient in nucleic acid elution when compared to similar glass or silica-based matrices.

Figure 8A:
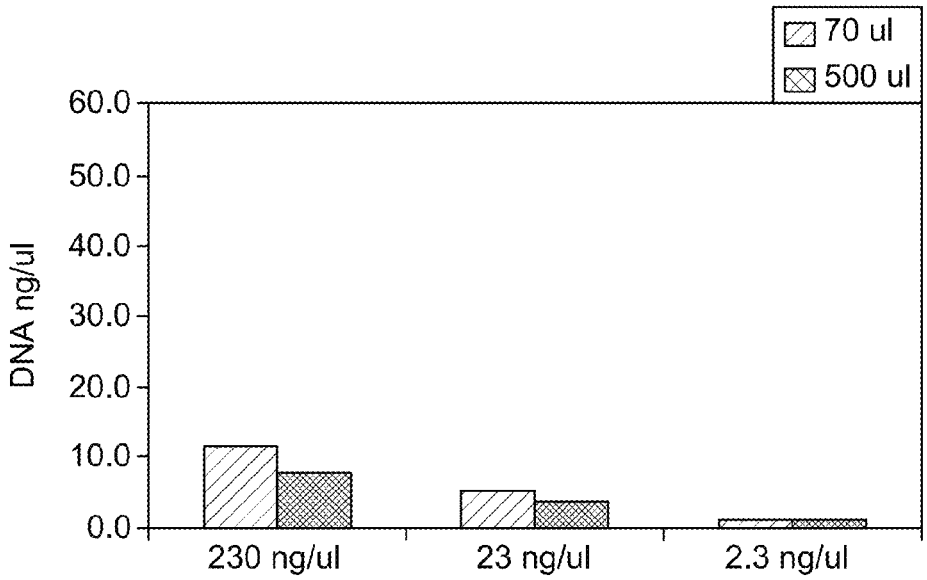
FIGS. 8A and 8B are graphs showing the DNA yield from an embodiment of a device of the invention, using a single membrane and multiple membranes, respectively.

In addition, unlike a typical FTA® paper card, integration of the glass-FTA (GFA, from GE) or quartz-FTA (QMA, from GE) with the EOP within the device enables loading of larger sample volumes, due to chemical interaction of nucleic acids with the card. In addition, the EOP provides an internal or self-contained pressure source for washing and eluting the nucleic acids. In some embodiments, a larger sample size may be accommodated using the quartz-based matrix by continuously pulling nucleic acids through the matrix, eliminating the drying step typically required in FTA processing, followed by elution using an EOP. For example, a larger blood sample, such as a 70 μl sample, may be dried onto the quartz-based FTA matrix, wherein the FTA® reagent can lyse the cells and elute the nucleic acids using the EOP. In some other embodiments, by increasing the number of solid phase extraction matrices, the load volume or capacity of the sample may be increased. For example, by using three membranes, the load capacity of the device is increased (FIG. 8B), when compared to one membrane (FIG. 8A).

The biomolecules, such as nucleic acids, are extracted from cells after cell lysis, when the cells are in contact with the matrix-bound lysis reagents. In one or more embodiments, the solid phase extraction matrix is configured to immobilize the nucleic acids after extraction from cells. Typically, nucleic acids are bound to a solid phase extraction matrix by a salt bridge, hydrogen bonding, ionic interaction or physical entanglement. Unlike a cellulose-based matrix, where nucleic acids are physically entangled, the extracted nucleic acids are bound to the glass or quartz-based solid phase extraction matrix using a salt bridge interaction or hydrogen bonding. In one example, in which the nucleic acids are physically entangled to the FTA®-cellulose membrane, the release of the nucleic acids required longer incubations, when compared to other matrices. In some embodiments, the nucleic acids bind to the glass or quartz-based matrices using salt bridge or hydrogen bonding interactions, whereby, the nucleic acid detachment from those matrices is much easier when compared to other matrices, such as cellulose. The easy release of nucleic acids from the quartz-based matrix also helps to preclude using a harsh treatment on the nucleic acids, such as heating the matrices at high temperatures to elute nucleic acids, which would otherwise increase the degradation of the nucleic acids.

Stabilization of the intact nucleic acid is also desired. Accordingly, in one or more embodiments, the matrix may further comprise one or more stabilizing reagents for storing nucleic acids, which helps to stabilize the nucleic acids and prevent further degradation.

In one example, use of chelating agents, such as EDTA serves to stabilize the nucleic acids. In some examples, typically EDTA inhibits nuclease, which is an enzyme that degrades nucleic acids. The nuclease inhibition further reduces the rate of degradation of the nucleic acids present on the matrix. The function of the chelating agent is to bind the divalent metal ions, such as magnesium, calcium, or transition metal ions, such as iron. Some of the divalent metal ions, for example, calcium and magnesium are known to promote nucleic acid degradation by acting as co-factors for enzymes, like exonucleases. In addition, the redox reaction of the divalent metal ions such as iron, may also damage nucleic acids by generating free radicals.

In a buffer reconstitution substrate, the dried, semi-dried or wet buffer is reconstituted using a fluid contained in or flow through the EOP. In some other embodiments, a buffer is reconstituted using a liquid supplied from outside of the device. In some embodiments, the buffer reconstitution substrate comprises one or more reagents, which can be reconstituted to a wash buffer and an elution buffer. In some embodiments, air or a second liquid phase may be used to separate multiple, operationally-coupled, liquid chambers to allow a liquid buffer exchange.

In some embodiments, a buffer exchange or reconstitution is conducted on a substrate of a reagent storage location 14, which is placed between the pressure source 32, such as an EOP and the extraction matrix 18. In some embodiments, the buffer exchange enables reconstitution of different buffers or reagents that may be necessary for biomolecule extraction and purification using the running buffer typically used in an EOP, as shown in FIGS. 2, 3 and 4. This eliminates the need to utilize the EOP in a direct pumping fashion, where the liquid used for EOP is the liquid that is delivered and utilized for down-stream biomolecule purification.

A higher flow rate is obtainable using the EOP, wherein the EOP enables intake of larger sample volumes. In some embodiments, the EOP pulls the sample with high pressure, which enables the device to have a higher sample load volume.

In one or more embodiments, a buffer reconstitution substrate, which is used for housing the wash buffer and elution buffer, is typically made of a thin substrate, to provide a compact portable nucleic acid purification device requiring minimal pressure for fluid flow through the substrate. Moreover, the thin substrate facilitates faster reconstitution of reagents to the fluid to form the wash or elution buffer during operation.

The composition of the buffer reconstitution substrate may vary. The buffer reconstitution substrate may comprise a metal, polymer, glass, silica or combinations thereof. The substrate may be a metallic sheet or bar and the buffer reservoirs are embedded therein. The substrate may be a polymeric substrate, such as a cellulose membrane, paper, nylon matrix. The polymeric substrate may comprise polymers, for example, the polymers are selected from polydimethyl siloxane (PDMS), cyclic olefin copolymer (COC), polymethyl methacrylate (PMMA), poly carbonate (PC) or other materials with graft able surface chemistries. In some embodiments, the substrate is made of silica, glass, quartz or combinations thereof. In some embodiments, the substrate may be a quartz-based membrane or matrix.

The buffer reconstitution substrate may be hydrophilic, which enables the membrane to wet out quickly and completely. The hydrophilic substrate eliminates the need for expensive pre-wetting treatment and increases the flow rate of the fluid passing through the substrate.

In some embodiments, the wash buffer reservoir and elution buffer reservoir are separated by a partition. The partition may be made, for example, of a membrane, such as a metallic or polymeric strip or sheet. The wash buffer reservoir and the elution buffer reservoir may each comprise one inlet and one outlet. In one or more embodiments, the wash buffer reservoir and the elution buffer reservoir may each comprise one inlet, wherein both of the inlets are connected to one conduit, which may be further connected to the downstream EOP.

The device may further comprise one or more valves. At least one of the valves is operationally coupled to the EOP and the reagent storage location. The valve is operationally coupled to the reagent storage location and the substrate. In this embodiment, the flow of liquid to the buffer reconstitution substrate comprising wash buffer and the elution buffer is controlled by one or more valves. The liquid passes from the EOP to the buffer reconstitution substrate for reconstituting the wash buffer reagents or elution buffer reagents.

In some embodiments, an area of a substrate containing impregnated wash buffer reagent is separated from the rest of the substrate by a membrane or partition, or is enclosed in a chamber. The area is referred in this example as a wash buffer reservoir. In some embodiments, an area of a substrate containing impregnated elution buffer reagent is separated from the rest of the substrate by a membrane or partition, or is enclosed in a chamber. The area is referred to in this example as an elution buffer reservoir. The wash buffer and elution buffer reservoirs may be coupled to other parts of the device through conduits. The conduits have an inlet and an outlet to the reservoirs. The outlet for wash and elution buffer reservoir may be different. Each of the reservoirs may comprise at least one outlet, wherein the outlets from both the reservoirs may be connected to one or more conduits, which are further connected to the extraction matrix through one or more valves. The two reservoirs may have two outlets, wherein the outlets are connected with one common conduit, which opens to the substrate or extraction matrix.

The wash buffer reagents may be present in the substrate in a dried, semi-dried or wet form. The wash buffer reagents are required to be hydrated by a buffer solution, water or any solvent, wherein the reagents are present in the dried form. In some embodiments, the reagents are rehydrated before use for washing the matrix. The hydration is also required, when the reagents are in semi-dried condition. After hydration, the reagents are dissolved in a buffer or solvent forming a wash buffer solution followed by transfer of the solution to the extraction matrix.

In some embodiments, the wash buffer reagents may comprise a detergent or chaotrope, that reduces various intra or inter molecular interactions between different organic or inorganic molecules, cell debris, lipids, proteins and the interactions of the one or more of them with the matrix. The wash buffer may remove the cell debris, excess lytic reagents or other impurities from the matrix after cell lysis, leaving the nucleic acids attached to the matrix. The wash buffer may further comprise one or more stabilizing agents or chelating agents, such as EDTA, which is used for nucleic acid stabilization.

The elution buffer reservoir may comprise elution buffer reagents impregnated in the matrix. In one or more embodiments, the elution buffer reagent may comprise TE buffer. In one embodiment, 1×TE buffer with 0.1% Tween is dried on cellulose paper as elution buffer reservoir. Elution and storage of the nucleic acids in TE buffer is helpful if the EDTA does not affect downstream applications. EDTA chelates divalent ions, such as magnesium, which may be present in the purified nucleic acids. The EDTA inhibits contaminating nuclease activity, as the divalent cations function as a cofactor for many of the nucleases under certain conditions. In one or more embodiments, the elution buffer reagent is present in the substrate in a dried, semi-dried or wet form. The reagents may be hydrated or rehydrated before eluting the nucleic acids from the matrix.

In some embodiments, the liquid may flow through the fluid circuit and subsequently releases the liquid. The use of a controlled pressure source may enable controlling the flow of a liquid at a steady flow rate. In one embodiment, the pressure source may be a high pressure generating EOP using low applied voltage, wherein the EOP may either be powered with a small battery source or using a battery free EOP. The pressure source, such as an EOP, is operationally coupled to the extraction matrix directly or indirectly. In some embodiments, the pressure source, such as an EOP, is operationally coupled to the extraction matrix through a small channel that controls the pressure. The high pressure, such as a pressure of equal to or more than 1 PSI obtained by the EOP.

In some embodiments, the EOP is activated by an external or internal power source. In some embodiments, power source may be an electrical switch for an EOP operation. Upon activation of the pressure source 32 with positive voltage (+V), a pressure builds in the EOP causes release of the stored liquid to the extraction substrate.

In some embodiments, the pressure source such as EOP is used to retain a control over the release of the stored liquid, allowing reversible control over flow rates in and out of the pump. In one embodiment, an EOP is operationally coupled to a sample inlet, wherein the EOP actuation results in a negative pressure exerted on the sample to control intake into the device. In some embodiments, the EOP-controlled release of liquid from the EOP allows temporal control of the buffer exchange or reconstitution. The control of buffer release optimizes a concentration of the buffer before reaching to the substrate, such as an extraction matrix. The liquid flow and the reconstitution rate may be controlled by varying the voltage or current applied across the EOP element.

In one embodiment, the EOP controls fluid flow in both direction, and the fluid rehydrates the sample or reconstitutes the dried buffer reagents. The fluid-flow in both the directions may enhance uptake of the liquid, release of the liquid, or re-uptake of the released liquid. The fluid-flow in both the directions may control the release of the stored liquid, for example by pulsing EOP to release liquid in short intervals, or by optimizing the flow rate of the released liquid. The liquid flow in both the directions enables the device to incubate the reagent with the liquid, which results in better hydration of the dried reagents. The liquid flow in both the directions also increases the time for reagent mixing before flowing to the extraction matrix.

The EOP may be configured to maintain high electric field strength across large pump surface areas, to produce a high pressure output at low running voltages, and only requires a small footprint. In some embodiments, a voltage of about 1 to 25 volts is sufficient to generate the high pressure required for driving the fluidic circuit of the device. In some embodiments, the EOPs comprise a plurality of membranes and electrodes, which solve various problems including, bubble formation or reduced field strength and generate a high pressure even at a lower applied voltage using a simple fabrication technique. Accurately controlled electrode-spacing within a thick and dense network of pores in the EOPs provides a solution for maintaining high electric field strength at low running voltages.

One or more embodiments of the EOP comprise a plurality of membranes comprising one or more positive electroosmotic membranes and one or more negative electroosmotic membranes, a plurality of electrodes comprising cathodes and anodes, and a power source. Each of the positive electroosmotic membranes and negative electroosmotic membranes are disposed alternatively and wherein at least one of the cathodes is disposed on one side of one of the membranes and at least one of the anodes is disposed on the other side of the membrane and wherein at least one of the cathodes or anodes is disposed between a positive electroosmotic membrane and negative electroosmotic membrane. In one embodiment, the EOP is configured to generate a run at an applied potential of less than or equal to about 25 V for operating fluids in the device. In one embodiment, the EOP generates a flow rate of about 100 μL/min. Such EOP is structured and fabricated as described in U.S. patent application Ser. No. 13/326,653, entitled "Electroosmotic Pump and Method of Use Thereof", filed Dec. 15, 2011.

In one or more embodiments, the EOP is a self-contained EOP, wherein the EOP is devoid of any external power source. The EOPs, as described herein, that comprises a plurality of membranes and pre-charged, chargeable or rechargeable electrodes, which eliminates the need for external power sources to drive EOPs and generating a high pressure even at a lower applied voltage. In one embodiment, the EOP is configured to generate pressure applying a chemical potential of about 3 V for operating the device. The EOP comprises a plurality of electrodes comprising a material capable of discharging for about 1 hour while running the pump with a flow rate of about 0.5 μL/min. The use of self-contained high pressure EOPs further reduce the expense and spatial requirements for implementing EOP based fluid control in larger systems and devices. Such EOP is structured and fabricated as described in U.S. patent application Ser. No. 13/429,471, entitled "Self-contained Electroosmotic Pump and Method of Use Thereof", filed Mar. 26, 2012.

In one embodiment, the EOP is operationally controlled by a controller. In some embodiments, a switch or a controller triggers the washing step and the elution step, whichever is required. The EOP may be operated repeatedly for washing steps depending on the various requirements, such as purity, yield or quality of nucleic acids, for the downstream applications.

In some embodiments, the EOP may be pre-programmed so that the EOP triggers a first cycle of operation to reconstitute wash buffer and transfer the buffer to the extraction matrix for washing the matrix bound biomolecules. In this embodiment, the EOP may also be programmed, so that after the washing step, the EOP triggers the next cycle to elute the nucleic acids from the matrix. The EOP may be programmed so that each of the cycles (wash or elution) is time-controlled.

Figure 7A:
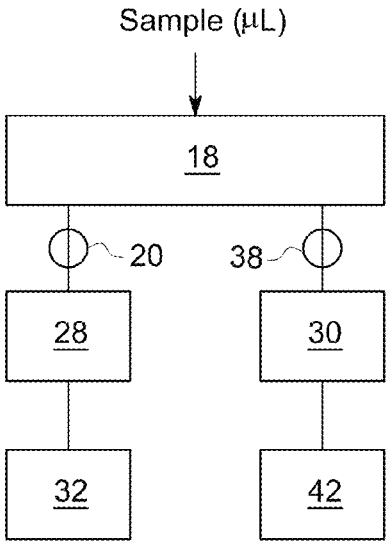
FIGS. 7A-7C illustrate an example of a method for isolating nucleic acids using the device of the invention comprising the steps of loading, washing and elution, respectively.
Figure 7B:
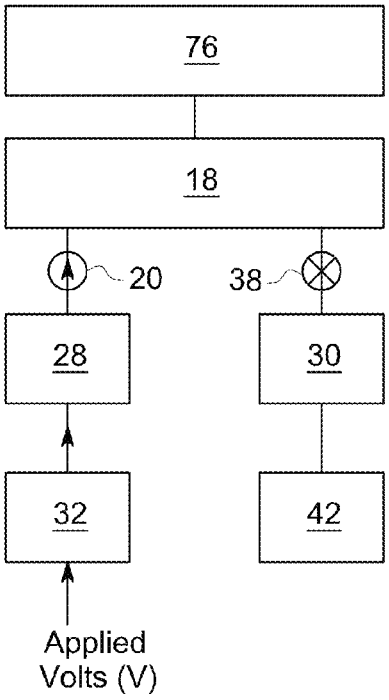
Figure 7C:
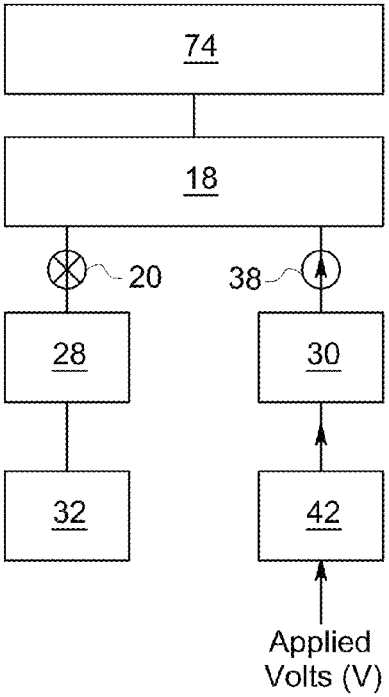

In some embodiments, the device comprises two EOPs, wherein one EOP is operationally coupled to the wash buffer reservoir and one EOP is operationally coupled to the elution buffer reservoir. Each of the EOPs operates separately for the washing and elution steps, as shown in FIGS. 7A-7C. In this embodiment, each of the EOPs is coupled to each of the wash buffer and elution buffer reservoirs (FIG. 4). One EOP may be connected to the wash buffer reservoir by a conduit and the other EOP is connected to the elution buffer reservoir by another conduit, wherein each of the conduits opens to the wash buffer reservoir as the wash buffer inlet and the elution buffer reservoir as the elution buffer inlet. The device may further comprise more than two EOPs, depending on the application requirement.

The embodiments, where one EOP drives two different steps, such as washing and elution, the third layer and the second layer are connected through a common conduit, which may have two openings, wherein one is in the wash buffer reservoir as a wash buffer inlet, and another is in the elution buffer reservoir as an elution buffer inlet, as shown in FIG. 2. The common conduit may comprise a valve, which in one cycle may open the wash buffer reservoir and in another cycle may open the elution buffer reservoir. The conduit that is connected to the wash buffer reservoir and the elution buffer reservoir may be coupled to a valve to control the fluid flow to the appropriate reservoirs. In one or more embodiments, the operation of the controller and the valves for operating the EOP may be pre-programmed, wherein the device is automated.

In one or more embodiments, the device further comprises at least one valve. In some examples, the valve is disposed between the solid phase extraction matrix and the buffer reconstitution substrate, wherein the valve is operationally coupled to the wash buffer reservoir and the elution buffer reservoir (FIG. 3). The valve is operationally coupled to the solid phase extraction matrix, wherein the solid phase extraction matrix, buffer reconstitution substrate and EOP are operationally coupled to each other. In some embodiments, the valve may be a check valve, which is operationally coupled to the wash buffer reservoir and the elution buffer reservoir. The same check valve may be operationally coupled to the solid phase extraction matrix. In this embodiment, the check valve is coupled to the wash buffer reservoir and the elution buffer reservoir with two different conduits. One or more conduits or connections are present between the valve and the solid phase extraction matrix, as shown in FIG. 3. In this example, the valve maintains a flow of fluid from the wash buffer reservoir to the solid phase extraction matrix. The valve also controls the fluid flow from the elution buffer reservoir to the solid phase extraction matrix. Depending on the requirement of wash buffer, the valve opens the conduit to wash buffer reservoir and closes the conduit to elution buffer reservoir and controls the wash buffer to the solid phase extraction matrix. Depending on the requirement of the elution buffer, the valve may open the conduit to the elution buffer reservoir and closes the conduit to wash buffer reservoir and may control the elution buffer to the solid phase extraction matrix.

In one or more examples of the method may use more than one valve, to control the fluid flow from the wash buffer reservoir to the solid phase extraction matrix and from the elution buffer reservoir to the solid phase extraction matrix. In some embodiments, the valve controls the flow of reconstituted buffer solution to the substrate. In some other embodiments, the valve also prevents the back-flow of reconstituted buffer into the EOP. In the case of back-flow, the reconstituted buffer solution may enter the EOP and change the EOP function by altering the zeta-potentials of the membrane employed in EOP.

The actuation of valves may be used to control the fluid flow, wash cycle and elution cycle through the device to isolate nucleic acids from the biological materials. One or more examples of a method of actuating a valve comprises, operatively coupling the valve with an EOP, flowing a fluid through the EOP, and generating a fluidic pressure to actuate the valve.

In one or more examples of methods, the steps of nucleic acid extraction are controlled using one or more controllers. One or more examples of the method further comprises controlling the EOP operation, fluid flow rate, fluid pressure, valve actuation, temperature of the device and fluid circuit, and combinations thereof. The EOP may also be operationally controlled by a controller. In some embodiments, a switch or a controller triggers the washing step and the elution step, as needed. In one embodiment, the controller controls the flow of a fluid through the solid phase extraction matrix, buffer reconstitution substrate and EOP. In one or more embodiments, the controller may be a microcontroller. In one or more embodiments, the device may comprise a control circuit to maintain a constant current or voltage for the EOP, and therefore maintains a constant fluid flow or pressure output during the operation of the device. As noted, in one embodiment, the controller for fluid flow may contain a check valve. In one embodiment, a controller may control the fluid flow by controlling the back pressure, which is generated by the EOP. In this embodiment, the controller is a pressure controller, which controls the EOP to generate a pressure. In one embodiment, the EOP is operationally controlled by a controller for washing and eluting the nucleic acids as per user requirement. In one embodiment, the device comprises a controller to maintain a constant fluid flow by regulating input voltage to the EOP. In some embodiments, the valve itself functions as a controller, while controlling the fluid flow. In one embodiment, the controller controls the overall MFM device to operate, wherein the controller is a switch for operating the device when the device is automated. The controller may be further pre-programmed before the operation depending on the application requirement or user requirement. The controller may comprise a micro controller circuit, wherein the controller may be a digital controller.

As noted, where the device is structured in multiple layers, the first, second and third layers may be operationally coupled to each other, wherein a fluid flows through the EOP of the third layer to the buffer reservoirs of the second layer. The first, second and third layers may be coupled to each other, when the device is in operation. The first, second and third layers may be disposed one after another and may be packaged in the integrated form. In some examples, one or more intervening layers may exist between the first, second and third layers of the device.

In some embodiments, the device is further operatively connected to at least one external reservoir comprising one or more fluids. In one embodiment, the pumping liquid or fluid or working solution for EOP is stored in the external reservoir. In one embodiment, the fluid stored in the external reservoir may be a buffer, water or other solvent. In some embodiments, the fluid has a pH from about 3.5 to 8.5. In an alternative embodiment, the pumping solution is a borate buffer with a pH of about 7.4 to 9.2 and an ionic strength between about 25 to about 250 mM.

In one or more embodiments, the device is configured to allow collection of biological waste material during the washing steps. The device further comprises a collection chamber for collecting the washing liquid after washing the matrix. The container may be a chamber, vessel, bag or disposable. In addition, the container for collecting waste may be altered for easy removal, and integration with down-stream analytical processes. In one or more embodiments, the container is coupled to the device for collecting the biological waste. The container may be coupled to the device directly or indirectly, using one or more conduits. The biological waste may contain tissue fragments, cell debris, lipids, excess reagents or other impurities.

Similarly, the device further comprises a container for collecting eluted nucleic acids. The container may be a chamber, vessel, bag or disposable. In addition, the container for collecting purified nucleic acid, may be altered for easy removal and integration with down-stream analytical processes. In one or more embodiments, the container is coupled to the device for collecting the purified nucleic acids. The container may be coupled to the device directly or indirectly, using one or more conduits or adapters.

Figure 5:
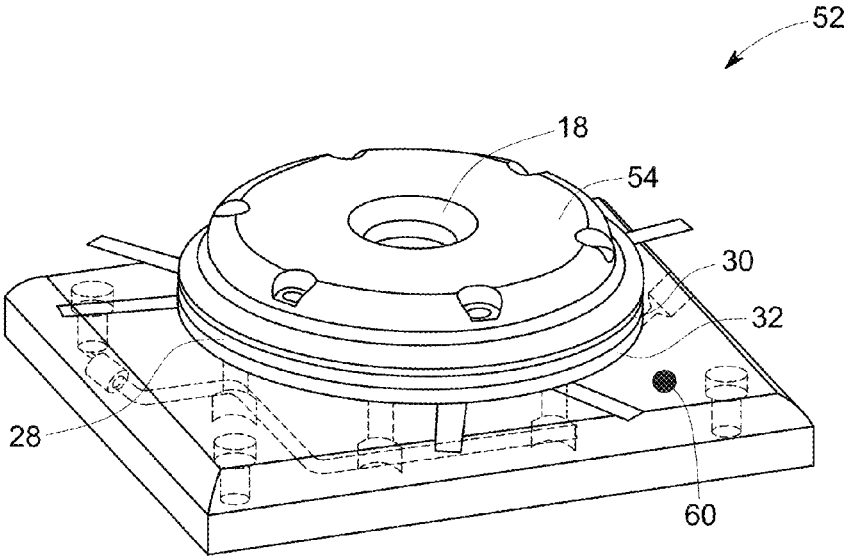
FIG. 5 is an embodiment of an image of the device of the invention.

FIG. 5 is a schematic drawing of a non-limiting example of an overall device structure 52, and the inset is magnified to show various parts of the device. FIG. 5 shows various parts embodied in the device 52, such as sample collection cap 54, which is present on the top of the device. The collection cap covers the area or surface of the substrate 18, such as solid phase extraction matrix, where the biological sample is loaded for isolation of the nucleic acids. The device comprises a matrix comprising a wash buffer storage location 28 and elution buffer storage location 30. The buffer reservoir may have a separation in between to generate two different types of buffer reservoir, such as wash buffer and elution buffer reservoirs. The device further has an EOP 32 and a controller 60.

In some embodiments, the nucleic acids isolated from biological material include deoxyribonucleic acids (DNAs) or ribonucleic acids (RNAs). In one embodiment, the nucleic acid is deoxyribonucleic acids (DNAs). In one or more embodiments, the DNA may be a genomic DNA, chromosomal DNA, bacterial DNA, plasmid DNA, plant DNA, synthetic DNA, a recombinant DNA, an amplified DNA and combinations thereof.

In one or more embodiments, the elution process of nucleic acid is carried out under reduced-degradation condition. Unlike conventional paper or membrane based nucleic acid extraction device or related method or kit, the MFM device purify nucleic acids under reduced degradation condition. The high molecular weight nucleic acids, such as nucleic acids having molecular weight greater than 10 kb, are desirable from the sample in a substantially intact form. Under reduced-degradation condition, the substantially intact form of the nucleic acid may be recovered. The nucleic acids are extracted and purified by a process that prevents or reduces the degradation of the nucleic acids. In some embodiments, the nucleic acids having molecular weight greater than or equal to 20 kb are eluted using the MFM device. For example, the mouse genomic DNA having molecular weight of 20 kb is isolated using the MFM device. In some embodiments, the isolated nucleic acids are greater than 30 kb, for example human genomic DNA.

As noted, the isolation of nucleic acids from biological material is carried out using the MFM device, the biological materials used in the embodiments may comprise a physiological body fluid, a pathological body fluid, a cell extract, a tissue sample, a cell suspension, a liquid comprising nucleic acids, a forensic sample and combinations thereof. In some embodiments, the biological material is a physiological body fluid or a pathological body fluid, such as the fluid generated from secretions, excretions, exudates, and transudates, or cell suspensions such as, blood, lymph, synovial fluid, semen, saliva containing buccal swab or sputum, skin scrapings or hair root cells, cell extracts or cell suspensions of humans or animals. In some embodiments, the physiological/pathological liquids or cell suspensions may be extracted from plants. In one or more embodiments, the extracts or suspensions of parasites, bacteria, fungi, plasmids, or viruses, human or animal body tissues such as bone, liver or kidney. The biological material may also include a liquid comprising DNA, RNA and combinations thereof, mixtures of chemically or biochemically synthesized DNA or RNA. The device may be portable or field-able, so that the biological materials can be collected from any place and load to the device to isolate nucleic acids under reduced degradation condition for faster downstream analysis.

In some examples, the MFM devices described herein may run on small batteries, and thus used as hand held devices. In some embodiments, the MFM device comprises the self-contained (battery-free) EOP, wherein the MFM device can run as a self-contained device without requiring any external power source. In one embodiment, the MFM device is packaged with a power source, wherein the entire assembly may be self-contained. In such embodiments, the MFM device is a portable, field-able, simplified, user friendly device to operate and carry as per the user need.

In some embodiments, the device provides a storage facility for nucleic acids. In some embodiments, the MFM device is configured to store the nucleic acids for at least eight to ten hours, if the downstream application facility is not instantly available. For example, the nucleic acid is required to store for few hours, when the nucleic acid is isolated from a blood sample collected from a field and the downstream application facility is situated in a distant location.

In some embodiments, the core structure for the MFM device may be adapted to function with other system components such as, for example, fluid chambers, inlet port(s), and outlet port (s). The applications for MFM include, but are not limited to, lab-on-a-chip devices and applications, drug delivery, liquid drug delivery, biochemical analysis, genomics, proteomics, healthcare related applications, defense and public safety applications; medical applications, pharmaceutical or biotech research applications, environmental monitoring, in vitro diagnostic and point-of-care applications, or medical devices. Other applications include, but are not limited to, DNA amplification, DNA purification, PCR or real time PCR on a chip, or adaptive microfluidic mirror arrays.

In one or more embodiments, the device is fully automated or partially automated. The automation of the device is required to reduce the human intervention during extraction and purification of the nucleic acids. The use of automated device further helps in minimizing the contamination during nucleic acid purification from various biological samples. Fully automatic device is desirable in case of forensic applications, wherein the objective is to purify nucleic acids from a trace amount of sample. An externally located controller may be operationally coupled to the device to drive the system, excluding any manual intervention after application of the biological sample to the device or sample inlet.

In some embodiments, the device is configured to integrate with a system, more specifically with an analytical system. As noted, the device may have one or more attachments through which the device may integrate with another system depending on the requirement. One or more adapters may be used to couple the device with another system. In one embodiment, the adapter has a holder to hold the device and a connecter for connecting to the system. In some other embodiments, an adapter may be attached to the device, wherein the adapter has at least two holders for holding the device and the system on it, and thereby couple the device with the system. For example, an adapter is used for coupling the MFM device with a downstream analytical system. In some embodiments, the device itself is configured to have one or more holders, connecting ports or combination thereof, which mechanically couples the device to another system. The device may be electronically coupled to another system for downstream applications.

As noted, the device is configured to integrate with a system, the system may be a microfluidic system or a conventional analytical system. In one embodiment, the MFM device is coupled to a downstream microfluidic system. By translating and miniaturizing the device, the need for manual intervention between different steps is eliminated. In one embodiment, the MFM device comprises multiple membrane-based EOP, while integrated the device with a microfluidic system. The multiple membrane-based EOP enables to achieve stable flow rates of the fluid by generating high pumping pressure, even when the device is housed into channels or structures with high hydraulic resistance. The MFM device may also be operatively coupled to various downstream analytical systems.

One or more embodiments of a system, comprises a sample collection port, a MFM device, one or more reservoirs comprising a buffer, a solvent, a reagent or combinations thereof, a port for priming the multifunctional membrane device with the buffer or solvent; and a controller.

In some other embodiments, a system comprises a sample collection port for collecting biological sample, a multifunctional membrane device, a port for priming the multifunctional membrane device with a buffer or solvent, and a controller. As noted previously, the multifunctional membrane device used herein comprises a substrate; a reagent storage location and an EOP, wherein the substrate, reagent storage location and EOP are operationally coupled to each other.

In some embodiments, the system is further integrated with one or more additional devices. As noted, the system is further integrated with one or more additional devices for various downstream applications, such as nucleic acid analysis, nucleic acid sequencing, nucleic acid amplification, disease detection and combinations thereof. The additional device may include, but are not limited to, a nucleic acid amplification device, such as a polymerase chain reaction (PCR) machine, a nucleic acid analyzer, or a nucleic acid sequencing machine.

In one or more embodiments, the system further comprises one or more containers for collecting nucleic acids or washing liquid. In one or more embodiments, the non-limiting examples of containers are bag, chamber and vessels. The containers may be disposable or reusable. Various components of the device may be operationally connected to each other using conduits, holder, adapter, or valves.

Figure 6:
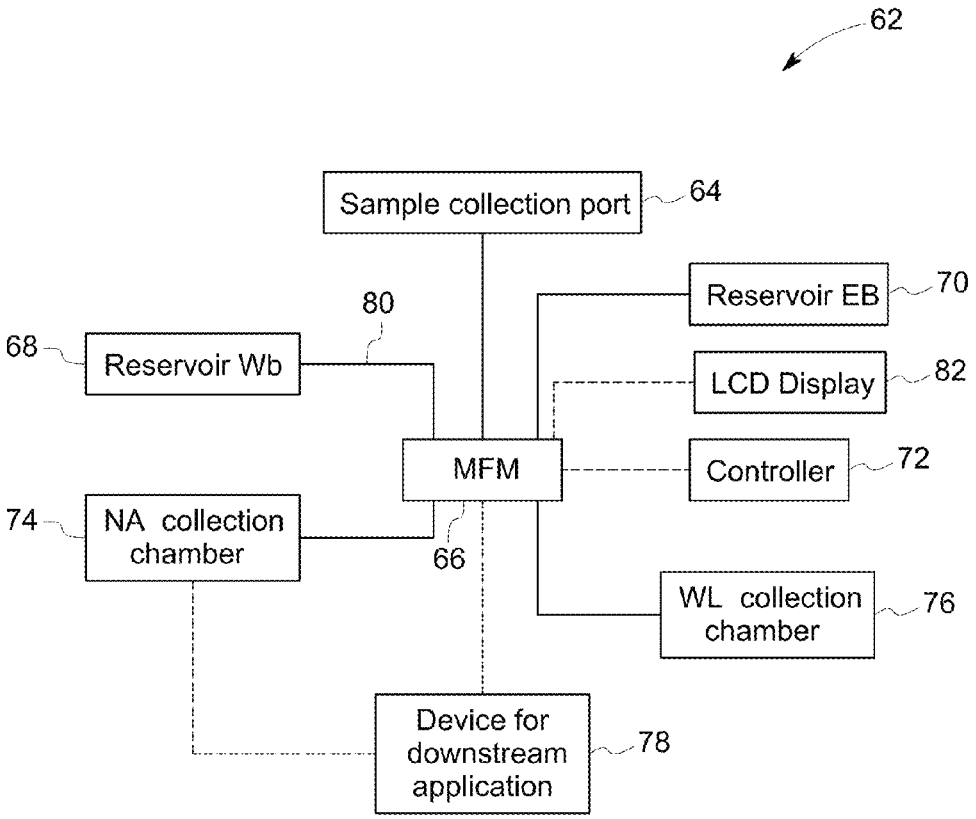
FIG. 6 is a schematic representation of an embodiment of a system comprising a multifunctional membrane device of the invention.

One embodiment of the system is schematically represented in FIG. 6. FIG. 6 illustrates the configuration of the system 62, wherein the system comprises a sample collection port 64, a MFM device 66, one or more reservoirs 68 and 70 comprising a buffer, a solvent, a reagent or combinations thereof, a port 80 for priming the MFM device 66 with the buffer or solvent; and a controller 72. The system further comprises one or more collection chamber/container for collecting nucleic acids 74 and washing liquid 76. In some embodiments, the system further comprises one or more additional devices 78 for various downstream applications of nucleic acids, such as nucleic acid analysis, sequencing, amplification, disease detection and combinations thereof. The system further comprises a LCD display 82, which may provide the information regarding load volume, operational pressure, vapor pressure of solvent, concentration of buffer solution, flow rate or temperature.

In one or more embodiments, a system comprises an extraction matrix, an enclosed matrix housing comprising a biological sample inlet, one or more biomolecule extraction reagents and at least one pressure source embedded therein, a fluidic extraction circuit; and a controller for activating the embedded pressure source, wherein the extraction matrix, the fluidic circuit and the controller are operationally coupled to each other, and the pressure source is configured to drive the fluidic extraction circuit.

In one or more embodiments, the controller is external from the housing and operationally connected to the pressure source. As noted, in some embodiments, the controller may be a microcontroller. In some embodiments, the controller and the device may be in a wired connection. In some other embodiments, the controller and the device may be in a wireless connection. In one embodiment, the system may operationally be coupled to a microprocessor unit. In some embodiments, one controller drives the whole system and the entire process starting from loading of the sample through purified nucleic acid collection.

In some embodiments, the system is fully automatic or partially automatic. As noted, the system is automatic, which reduces the manual intervention, as well as the time taken for the total process. The automatic system also reduces the probability of contamination during purification. In one embodiment, the automatic or semi-automatic system may run by operating a controller, as shown in FIG. 6. In some embodiments, the system may be pre-programmed by setting various parameters for operation before running the system. The parameters may be modified or re-set during the operation depending on the user requirement.

An embodiment of a method of isolating biomolecules from a biological material, comprises applying the biological material on a quartz-based solid phase extraction matrix comprising one or more cell lysis reagents impregnated therein; applying a fluid to the biological material applied on the quartz-based solid phase extraction matrix; extracting the nucleic acids from the biological material applied on the solid phase extraction matrix; and collecting the extracted nucleic acids in a substantially intact form, without any human intervention, wherein applying the fluid to extract and collect the nucleic acids by electroosmotic pump (EOP).

In some other embodiments, a method of isolating nucleic acids from a biological material comprises applying a fluid to the biological material disposed on a substrate at a flow rate of less than or equal to 0.1 ml/volt/cm$^2$/minute; extracting the biomolecules from the biological material; and collecting the extracted biomolecules in a substantially intact form. As noted, the substrate comprises one or more cell-lysis reagent. In some embodiments, the method further comprises hydrating the cell lysis reagent on the substrate to extract the biomolecules from the biological material.

In some embodiments, the method of isolating biomolecules from a biological material, comprises applying a voltage of less than or equal to 25 volts; applying a fluid to the biological material disposed on a substrate at pressure of greater than or equal to 1 PSI; extracting the biomolecules from the biological material disposed on the substrate comprising one or more cell lysis reagents; and collecting the extracted biomolecules in a substantially intact form. In some other embodiments, the method comprises applying a voltage of less than or equal to 3 volts, wherein a pressure of greater than or equal to 1 PSI is generated. A pressure of greater than or equal to 1 PSI is generated using an EOP, and the fluid is applied to the biological material disposed on a substrate at under 1 PSI pressure using a voltage of less than or equal to 3 volts.

In some embodiments, the method further comprises hydrating the cell lysis reagents on the substrate to extract the biomolecules from the biological material. The method further comprises immobilizing the extracted biomolecules on the substrate. In one or more embodiments, the method further comprises washing the biomolecules by applying a wash buffer to the biomolecules on the substrate. In other embodiments, the method further comprises eluting the biomolecules by applying an elution buffer to the biomolecules on the substrate for collection. The pressure of greater than or equal to 1 PSI is generated using a pressure source. In one or more embodiments, the pressure source is an EOP comprises a plurality of electroosmotic membranes comprising one or more positive electroosmotic membranes and one or more negative electroosmotic membranes disposed alternatively and a plurality of electrodes comprising one or more cathodes and one or more anodes, wherein at least one cathode is disposed on one side of one of the membranes and at least one anode is disposed on another side of that membrane and at least one cathode or anode is disposed between a positive electroosmotic membrane and a negative electroosmotic membrane.

In some other embodiments of a method of isolating nucleic acids from a biological material, comprises adding the biological sample to a first layer of the MFM device, washing the first layer with the wash buffer; and eluting the nucleic acids from the first layer using the elution buffer. The method enables to isolates the nucleic acid of a molecular weight greater than or equal to 20 kb. Moreover, the method enables eluting the nucleic acids under minimum nucleic acid degradation condition. In one embodiment of the method, the fluid flow for washing or eluting the nucleic acids are controlled using the EOP, which actuates the valve to control the fluid flow. The nucleic acids are eluted by pumping. In one embodiment, the biomolecules are eluted using the EOP.

In some embodiments of the method, the substrate comprises a microporous substrate, a nanoporous substrate or a combination of both. In the embodiment of the method wherein the substrate is a hybrid of a microporous and nanoporous substrate, the method comprises applying a biological material to a microporous substrate, entrapping nucleic acids of the biological materials on the substrate, utilizing the microporous substrate as a low pressure lateral flow matrix capable of generating capillary fluid flow to remove cell debris and other impurities. The method further comprises applying an electric potential across the nanoporous substrate to provide a high pressure electroosmotic flow (EOP) capable of eluting a high molecular weight nucleic acid from the microporous capture matrix (extraction matrix) via transverse electro-kinetic flow. The method is based on utilization of differential movement of biomolecules in the lateral versus transverse direction to obtain substantially pure and intact nucleic acids.

One example of method for isolating nucleic acids comprises various steps including sample loading, washing, or eluting the nucleic acids. During operation, the biological sample is loaded onto the solid phase extraction matrix 18, wherein the matrix is impregnated with cell lysis reagents. In this exemplary embodiment, the device comprises two EOPs 32 and 42, with regard to FIGS. 7A, 7B and 7C. The air flow is introduced to the substrate for drying the sample, in some embodiment, the sample is rapidly dried using fan or inbuilt heater. In some embodiments, the pump components 32 and 42 are not operational during loading, as shown in FIG. 7 A. The contacting of the biological materials including cells with the lysis reagents, results in cell lysis.

A voltage is applied to the EOP 32 of the third layer, which initiates a fluid to flow through the buffer reservoir 28 of the second layer. The fluid reconstitutes the wash buffer reagent and forms wash buffer that flows from the second layer to the first layer 18. Similarly, the fluid reconstitute elution buffer reagent to form elution buffer that flows from the second layer to the first layer. The wash buffer solution generates pressure to actuate the valve 20, which is present between the wash buffer reservoir 28 and the matrix 18, to open and allow the wash buffer to pass through. The wash buffer then flows from the second layer to the first layer. The wash buffer then washes away the impurities, cell debris, excess reagents from the matrix and collecting to a container 76, leaving the nucleic acids attached to the matrix, as shown in FIG. 7 B.

Then, in the next cycle, a voltage is applied to the EOP 42, results in activation of the pump to pass the fluid to the elution buffer reservoir 30, dissolute the elution buffer reagent and forms the elution buffer solution. The elution buffer solution generates pressure that actuates the valve 38, which is present between the elution buffer reservoir and the matrix, to open and allow the elution buffer to pass through. The elution buffer then flows from the second layer to the first layer, and detached the nucleic acids from the matrix 18 and eluted out, as shown in FIG. 7 C. The eluted nucleic acids are then collected to a container 74 for further use. In one or more embodiments, the nucleic acids are eluted from a matrix using electroosmotic forces. For example, the nucleic acids are eluted from the quartz-based matrix by EOP. Unlike conventional devices, the MFM device run with lower voltage, reducing the problem of decreasing electric field strength over time due to hydrolysis and bubble formation. The nucleic acids are eluted under non-degradation condition by electroosmotic pumping.

Example 1

Selection of Matrix for Efficient Sample Load

Materials: Solid phase extraction matrices used for the experiments, include 31-etf cellulose (GE-Whatman, UK), QMA quartz fiber membranes (GE-Whatman, UK), and GF-A or GF-C glass fiber membranes (GE-Whatman, UK). Illustra™ spin column (from GE Healthcare) was used for testing various matrices, reagents, buffers, and standardizing nucleic acid purification protocol. Illustra™ microspin column also served the purpose of control experiments or used as a control device as compared to the MFM chip (device of the invention) for different experiments. Illustra PuRe Taq Ready-to-Go™ PCR beads (from GE Healthcare) was used for DNA amplification using PCR.

Figure 8B:
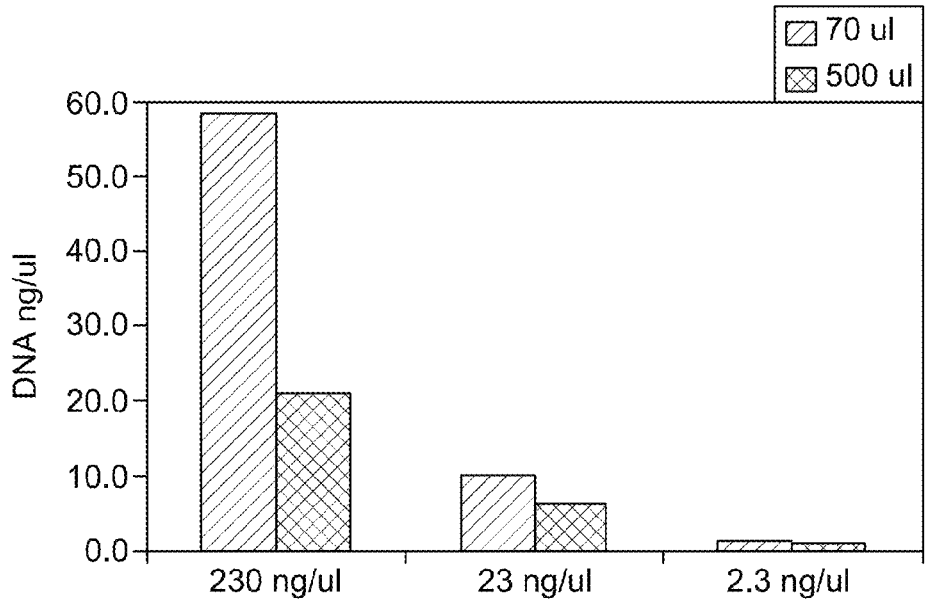

As mentioned, a number of matrices were used to compare the properties of matrices with respect to sample loading capacity. A larger sample size may be accommodated by eliminating the drying step and using the EOP to drive the sample through multiple quartz-based matrices. The yield of DNA using two different sample volumes applied to the quartz-based matrix was determined. Experiments were performed for 20 μL, 70 μl, and 500 μl sample volumes, and the yield of DNA was shown to decrease with increasing sample sizes. The DNA yield and concentration was measured using a fluorescent Picogreen Assay. Yields approaching 50% were obtained from single matrices at the lower input volumes (70 μL; see FIGS. 8A and 8B), when samples were completely dried after applying to the SPE matrix. The yields at the higher input volumes could be increased by simply stacking multiple matrices to provide higher surface area for DNA binding (FIG. 8B). FIG. 8A shows significant loss of DNA contained within the sample when using single matrix (eluted or collected volumes were 500 μL), without fully drying the sample. However, the graph illustrates that DNA in larger sample volumes may be retained by driving the sample through multiple collection matrices. In addition, the yield may be maintained by designing membrane stacks for specific sample sizes, and simply increasing the SPE surface area, and thus the concentration of the lytic reagents and the area for DNA binding within the quartz-based matrix.

Similarly, loading capacity of different matrices was also determined by comparative analysis of load capacity using cellulose, glass and quartz matrices. For this experiment, quartz matrix QMA cellulose matrix 31 ETF and glass matrix GF-A in spin column were used. An aqueous sample was added to each of the matrices, wherein the DNA was purified from the sample load and the loaded volume was compared, wherein the quartz matrix shows maximum capacity for sample load (data not shown).

Example 2

Selection of Matrix with Lysis Reagent to Increase Nucleic Acid Recovery

A number of matrices with different chaotrope/detergent solutions were used to compare the properties of matrices with respect to nucleic acid retention, isolation of nucleic acids from a complex sample, or loading capacity.

DNA yield using glass and quartz matrices were compared using multiple chaotrope/detergent combinations. Whatman™ Glass microfiber grade A (GF/A) was used as glass matrix, which is known for fine particle retention, high flow rate, as well as good loading capacity. The glass fibers were used in Illustra™ columns.

150 ng of *E. coli* cell extract was loaded on to each of the matrices. The lytic components of the matrix were rehydrated by the sample and non-nucleic acid materials were removed during the first washing step. Nucleic acids, such as DNA was eluted off from different types of matrices (sub-components of the MFM) using two different chaotropes KI and GuSCN in final concentration of 5 M. The combination of the weaker chaotrope (KI) and quartz-based membranes consistently showed the highest elution rates. The glass matrix in Illustra® column provided yields of 48% DNA, while the combination of quartz matrix and the KI chaotrope provided yield near 70% yield of DNA, as shown in FIG. 9. Therefore, the maximum DNA retention and yield was achieved by using the combination of quartz and KI as chaotrope. The results indicated that the weaker binding chaotrope (KI) may provide a surface chemistry, which proves beneficial in the electroosmotic flow-based MFM.

Example 3

Consistent Nucleic Acid Recovery from Elution Steps Using MFM Device

Figure 10:
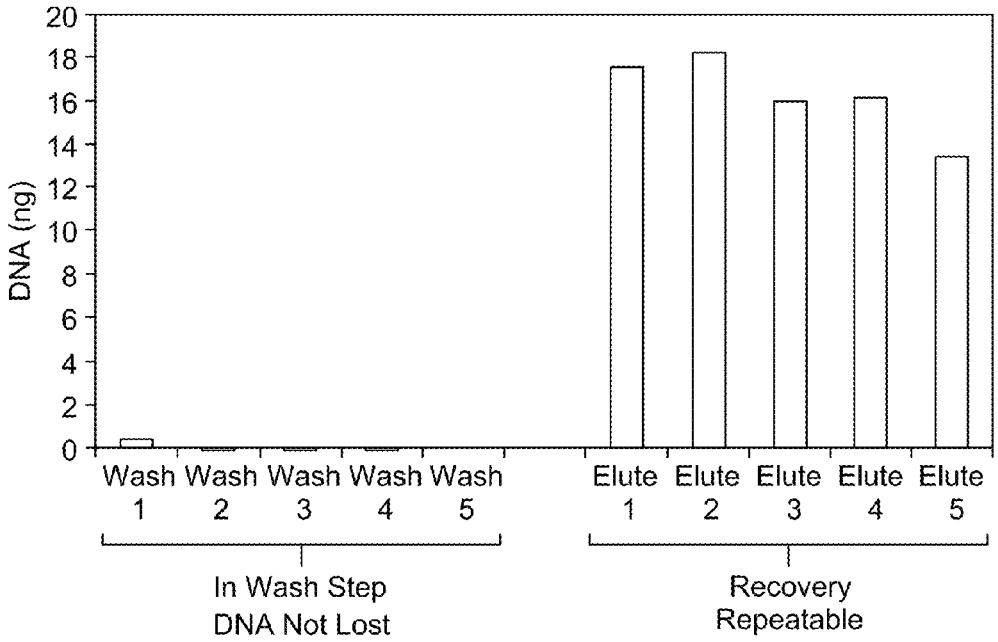
FIG. 10 is a graph showing recovery of DNA in wash liquid and elution liquid from an extraction matrix used in an embodiment of the device of the invention.
Figure 11:
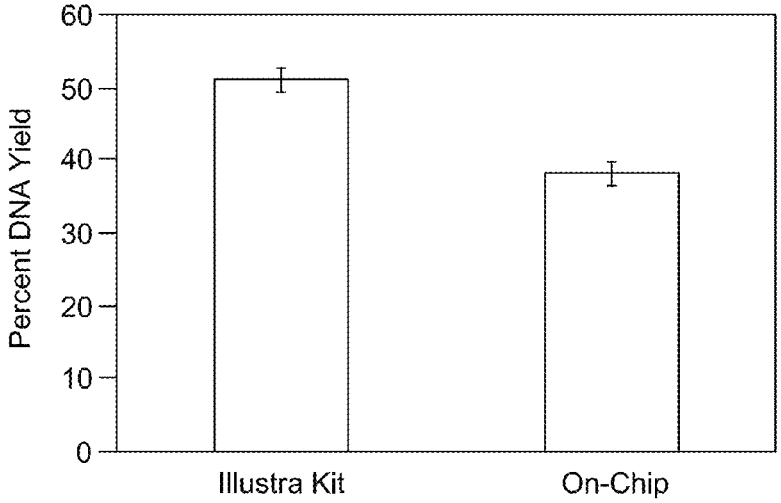
FIG. 11 is a graph showing recovery of DNA using an embodiment of the device of the invention and an Illustra™ Kit.

A sample of *E. coli* from an overnight culture was loaded on to the solid phase extraction (SPE) matrix of the MFM device, and dried for 30 minutes to ensure cell lysis. The SPE was impregnated with the cell lysis reagents, resulting in extraction of the nucleic acids, which bound to the SPE matrix. In the washing cycle, a 70% ethanol wash was passed through the SPE matrix to wash away the cell debris and other materials except bound nucleic acids, using a normal syringe pump. The washing step was repeated for five times. The wash liquid (a liquid after washing the impurities from the matrix) for each wash was collected in different tubes. The wash liquids were collected after five washes and were analyzed to determine presence of DNA using a Picogreen® fluorescence assay. FIG. 10 shows that wash liquid collected for wash 1 to wash 5 are mostly devoid of DNA. This observation confirms the minimum loss of DNA in washing step, whereas in the elution cycle, a TE buffer was again passed through the SPE matrix to elute the bound DNA. The elution step was repeated for five times and the eluted liquid (post elution fluid) was collected in different tubes. A consistent yield of DNA was achieved as shown in FIG. 10, wherein elute 1 to elute 5 contains about 15 to 18 ng of DNA. In addition, FIG. 11 shows an additional run where elution buffer was reconstituted within the device (shown in FIG. 11, as on chip), by running DI water through a cellulose membrane contained 20 μL of dried 10×TE. As shown, DNA collection efficiencies approached 50% when a 20 μL sample is fully dried on the SPE matrix. DNA yield using an Illustra™ kit and the device (on-chip) are comparable.

Example 4

Efficient Isolation of Nucleic Acids from a Complex Sample

Figure 12:
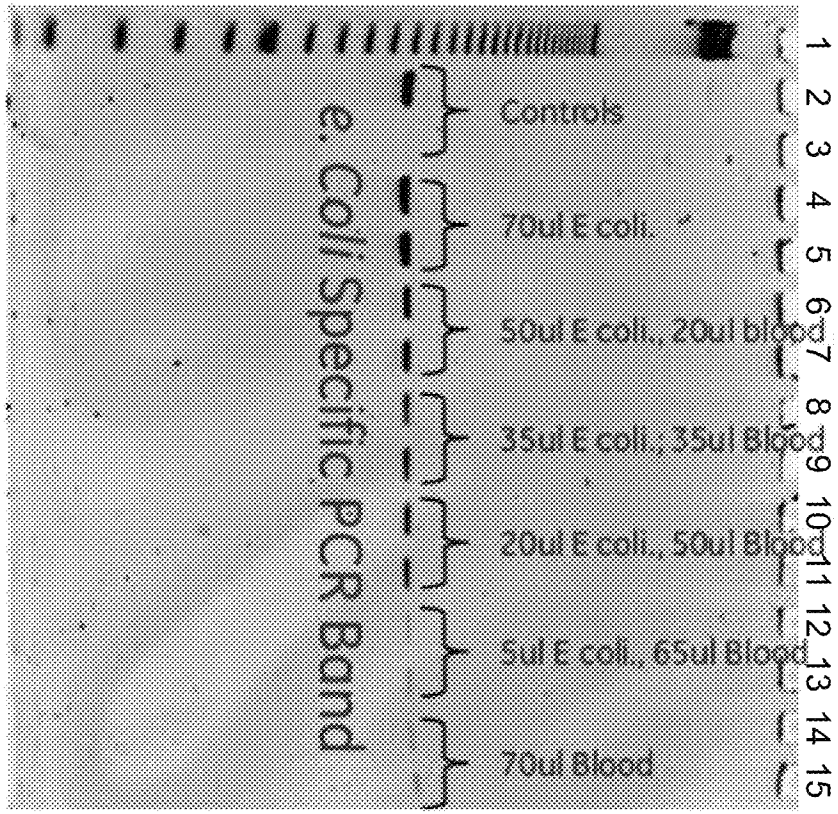
FIG. 12 is an image of a DNA gel electrophoresis showing amplified DNA bands produced by *E. coli* specific PCR amplification of DNA purified from a mouse blood mixed with *E. coli* cell extract using an embodiment of a device of the invention.

In another experiment, an *E. coli* specific PCR was performed using DNA from an *E. coli* spiked mouse blood. In this case, the mouse blood was mixed with *E. coli* cell extracts and loaded on to the SPE matrix. The quartz/KI combination was used for isolating *E. coli* DNA from the complex sample using the method described above. The eluted DNA was subjected to *E. coli* specific PCR analysis. PCR was performed using Illustra PuRe Taq Ready-to-Go™ PCR beads using *E. coli* specific primers (SEQ. ID. No 1: 5' TTAAAGTCTCGACGGCAGAAGCCA 3' and SEQ. ID. No 2: 5' AACATCTTTCATCAGCTTCGCGGC 3'). In the PCR, one amplicon was employed having SEQ. ID. No 3: 5'-TTAAAGTCTCGACGGCAGAAGCCAGGGC-TATTTTACCGGCGCAGTATCGC CGCCAGGATTGCAT-TGCGCACGGGCGACATCTGGCTGGCT-TCATTCACGC CTGCTATTCCCGTCAGCCTGAGCTTGC-CGCGAAGCTGATGAAAGATGTT-3'. In FIG. 12, lane 1 shows DNA ladder with different molecular weight DNA and lane 2 shows a band for DNA isolated from *E. coli* as positive control, wherein lane 3 is devoid of any band, as buffer was loaded as negative control. The intensity of the band decreases from lanes 4 to 13, while the volume of the *E. coli* extract decreases and the mouse blood increases. A faint band in the lanes 14 and 15 were observed, where the sample loaded is only blood, which may arise from a bacterial contamination from the collected mouse blood, as the control gave the correct negative results. Therefore, isolation of nucleic acids from a complex sample is also possible using a quartz matrix in combination with KI.

Example 5

Qualitative Analysis of Isolated Nucleic Acids

Figure 13:
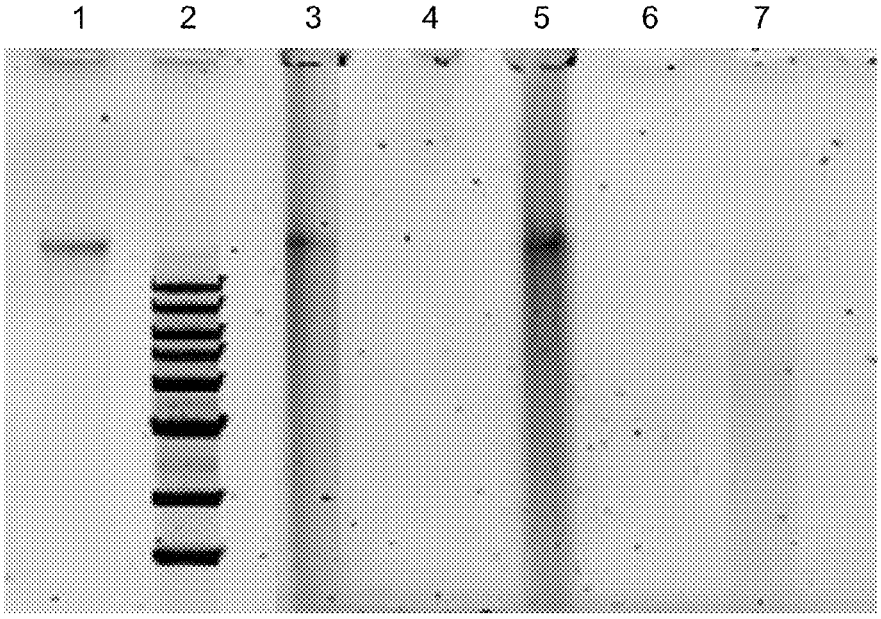
FIG. 13 is an image of a DNA gel electrophoresis showing recovery of intact DNA or degraded DNA under different elution conditions using traditional cellulose-based nucleic acid storage cards.
Figure 14:
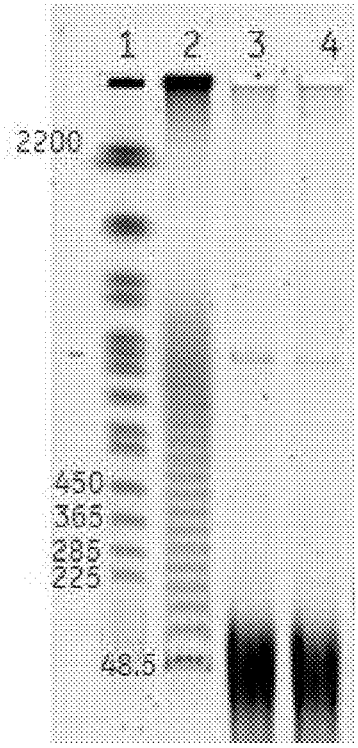
FIG. 14 is an image of a pulse field gel electrophoresis showing recovery of high molecular weight DNA using the device of an embodiment of the invention.

The purification of substantially intact form of the nucleic acids is also enabled as shown in FIG. 14 with compared to the degraded nucleic acids as shown in FIG. 13. The MFM device was used, wherein a sample from an *E. coli* culture was loaded on to the SPE matrix of the device. 70 μl of sample was loaded, followed by washing and elution of the DNA from the MFM device. 50 ng of DNA sample was loaded on to the pulse field agarose gel to determine the size and intactness of the DNA. DNA is shown to remain above 20 kb after elution from the device. In a separate test sample, cellulose based matrix impregnated with lytic reagents was used for same purpose. In one example, the membrane bound DNA was directly loaded on to the gel, in another example, the DNA was eluted out from the cellulose membrane by heating the membrane at 95° C. The isolated DNA sample was loaded on to the agarose gel (non-pulse field gel) for further analysis; DNA eluted using the traditional heat step at 95° C. for eluting DNA from cellulose storage cards showed significant degradation (FIG. 13).

Nucleic acids that were eluted using the traditional heating methods for cellulose storage membranes at higher temperature (95° C.) showed degraded nucleic acids, as shown in lane 7 of FIG. 13 (25 minute heat and elution). Lanes 1, 3 and 5 show un-eluted DNA band of more than 10 kb, wherein the DNA is bound to the membrane and loaded to the gel without heating the DNA sample. In contrast, the methods adopting the embedded EOP in the MFM enable eluting nucleic acids without any heat treatment and with minimum human intervention. The method results in purifying nucleic acids in a substantially intact form, with molecular weight between 10 to 50 kb, as shown about 46.5 kb bands in lanes 3 and 4 of FIG. 14. The FIG. 14 illustrates purification of substantially intact form of human genomic DNA using quartz-based FTA matrix.

While only certain features of the invention have been illustrated and described herein, many modifications and changes will occur to those skilled in the art. It is, therefore, to be understood that the appended claims are intended to cover all such modifications and changes as fall within the scope of the invention.

SEQUENCE LISTING

```
<160> NUMBER OF SEQ ID NOS: 3

<210> SEQ ID NO 1
<211> LENGTH: 24
<212> TYPE: DNA
<213> ORGANISM: Artificial Sequence
<220> FEATURE:
<223> OTHER INFORMATION: Description of Artificial Sequence: Synthetic
      primer

<400> SEQUENCE: 1
```

-continued

```
ttaaagtctc gacggcagaa gcca                                          24


<210> SEQ ID NO 2
<211> LENGTH: 24
<212> TYPE: DNA
<213> ORGANISM: Artificial Sequence
<220> FEATURE:
<223> OTHER INFORMATION: Description of Artificial Sequence: Synthetic
      primer

<400> SEQUENCE: 2

aacatctttc atcagcttcg cggc                                          24


<210> SEQ ID NO 3
<211> LENGTH: 149
<212> TYPE: DNA
<213> ORGANISM: Artificial Sequence
<220> FEATURE:
<223> OTHER INFORMATION: Description of Artificial Sequence: Synthetic
      polynucleotide

<400> SEQUENCE: 3

ttaaagtctc gacggcagaa gccagggcta ttttaccggc gcagtatcgc cgccaggatt     60

gcattgcgca cgggcgacat ctggctggct tcattcacgc ctgctattcc cgtcagcctg    120

agcttgccgc gaagctgatg aaagatgtt                                     149
```

The invention claimed is:

1. A device for isolating nucleic acids, comprising:

a quartz-based solid phase extraction matrix; and an electroosmotic pump (EOP) operationally coupled to the quartz-based solid phase extraction matrix to elute the nucleic acids, wherein the EOP comprises a plurality of electroosmotic membranes comprising one or more positive electroosmotic membranes and one or more negative electroosmotic membranes disposed alternatively and a plurality of electrodes comprising one or more cathodes and one or more anodes, wherein at least one cathode is disposed on one side of one of the electroosmotic membranes and at least one anode is disposed on another side of that electroosmotic membrane and at least one cathode or anode is disposed between a positive electroosmotic membrane and a negative electroosmotic membrane, and wherein the EOP generates a pressure of greater than or equal to 1 PSI by application of a voltage of less than or equal to 3 volts.

2. The device of claim 1, wherein the solid phase extraction matrix comprises one or more reagents impregnated therein.

3. The device of claim 2, wherein one or more of the reagents comprise a cell lysis reagent, a nucleic acid stabilizing reagent, buffer reagents, or combinations thereof.

4. The device of claim 1, further comprising one or more valves.

5. The device of claim 1, wherein the nucleic acids are isolated from a biological material comprising a blood, plasma, serum, buccal swabs, sputum, spores, bacteria, plant, tissue sample, cell sample, cellular extract, and combinations thereof.

6. The device of claim 1, wherein the nucleic acids comprise deoxyribo nucleic acids (DNAs) or ribo nucleic acids (RNA).

7. The device of claim 1, wherein the EOP is configured to elute the nucleic acids in a substantially intact form.

8. The device of claim 1, wherein the EOP is configured to elute the nucleic acids of greater than or equals to 20 kb.

9. The device of claim 1, further comprises a reagent storage location comprising dried buffer reagents or reagents for nucleic acid extraction.

10. The device of claim 1, wherein the EOP is a self contained pump comprising rechargable electrodes.

11. The device of claim 1 is fully automated or partially automated.

12. The device of claim 1 is configured to integrate with an external device or a system.

13. A system, comprising:

a device for isolating nucleic acids, comprising:

a quartz based extraction matrix; and an electroosmotic pump (EOP) operationally coupled to the quartz based extraction matrix, wherein the EOP comprises a plurality of electroosmotic membranes comprising one or more positive electroosmotic membranes and one or more negative electroosmotic membranes disposed alternatively and a plurality of electrodes comprising one or more cathodes and one or more anodes, wherein at least one cathode is disposed on one side of one of the electroosmotic membranes and at least one anode is disposed on another side of that electroosmotic membrane and at least one cathode or anode is disposed between a positive electroosmotic membrane and a negative electroosmotic membrane, wherein the EOP generates a pressure of greater than or equal to 1 PSI by an application of a voltage of less than or equal to 3 volts;

one or more reservoirs comprising a buffer, a solvent, a reagent or combinations thereof, a fluidic circuit for flowing liquid through the device, and a controller.

* * * * *